US011074860B2

(12) United States Patent
Ding et al.

(10) Patent No.: US 11,074,860 B2
(45) Date of Patent: Jul. 27, 2021

(54) OPTICAL SIGNAL NOISE REDUCTION CIRCUIT, OPTICAL SIGNAL NOISE REDUCTION METHOD AND DISPLAY PANEL

(71) Applicant: BOE TECHNOLOGY GROUP CO., LTD., Beijing (CN)

(72) Inventors: Xiaoliang Ding, Beijing (CN); Xue Dong, Beijing (CN); Haisheng Wang, Beijing (CN); Yingming Liu, Beijing (CN); Wei Liu, Beijing (CN); Changfeng Li, Beijing (CN); Xueyou Cao, Beijing (CN); Pengpeng Wang, Beijing (CN); Liguang Deng, Beijing (CN)

(73) Assignee: Boe Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/609,417

(22) PCT Filed: Feb. 25, 2019

(86) PCT No.: PCT/CN2019/076015
§ 371 (c)(1),
(2) Date: Oct. 29, 2019

(87) PCT Pub. No.: WO2019/227987
PCT Pub. Date: Dec. 5, 2019

(65) Prior Publication Data

US 2020/0168161 A1 May 28, 2020

(30) Foreign Application Priority Data

May 31, 2018 (CN) ..... 201810550467.1

(51) Int. Cl.
*G09G 3/3233* (2016.01)

(52) U.S. Cl.
CPC ... *G09G 3/3233* (2013.01); *G09G 2320/0209* (2013.01); *G09G 2320/045* (2013.01); *G09G 2360/145* (2013.01)

(58) Field of Classification Search
None
See application file for complete search history.

(56) References Cited

U.S. PATENT DOCUMENTS 5,705,807 A * 1/1998 Throngnumchai ... G01J 1/4228 250/214 B
7,859,526 B2 12/2010 Konicek
(Continued)

FOREIGN PATENT DOCUMENTS

CN 1877401 A 12/2006
CN 101989140 A 3/2011
(Continued)

OTHER PUBLICATIONS

Office Action of CN Application No. 201810550467.1, dated Aug. 22, 2019, 6 pages.
(Continued)

*Primary Examiner* — Benjamin X Casarez
(74) *Attorney, Agent, or Firm* — Muncy, Geissler, Olds & Lowe, P.C.

(57) ABSTRACT

An optical signal noise reduction circuit includes a reference line, a comparison detection circuitry and a photoelectric signal read line. An electric signal on the photoelectric signal read line includes a noise electric signal and a photoelectric signal. The reference line is configured to sense the noise electric signal on the photoelectric signal read line, to generate a corresponding second electric signal. The comparison detection circuitry is connected to the reference line and the photoelectric signal read line and configured to acquire the photoelectric signal in accordance with the electric signal on the photoelectric signal read line and the
(Continued)

electric signal on the reference line. One or more optical signal noise reduction circuits are used in a display panel. The optical signal noise reduction circuit may be utilized in an optical signal noise reduction method.

15 Claims, 5 Drawing Sheets

(56) References Cited

U.S. PATENT DOCUMENTS

| | | | | |
|---|---|---|---|---|
| 2005/0168491 | A1* | 8/2005 | Takahara | G09G 3/3241 345/690 |
| 2006/0279690 | A1 | 12/2006 | Yu et al. | |
| 2007/0252005 | A1 | 11/2007 | Konicek | |
| 2007/0263016 | A1* | 11/2007 | Naugler, Jr. | G09G 3/3648 345/690 |
| 2010/0149079 | A1* | 6/2010 | Yamashita | G09G 3/3233 345/87 |
| 2012/0313913 | A1* | 12/2012 | Shiraki | G06K 9/0004 345/207 |
| 2016/0078805 | A1* | 3/2016 | Woo | G09G 3/3225 345/78 |
| 2016/0252992 | A1 | 9/2016 | Yang | |
| 2018/0218193 | A1* | 8/2018 | Ding | H01L 27/3234 |
| 2018/0323243 | A1* | 11/2018 | Wang | H01L 27/3281 |
| 2018/0357464 | A1* | 12/2018 | Wang | H01L 27/3234 |
| 2018/0365473 | A1* | 12/2018 | Wang | G09G 3/3426 |
| 2020/0212137 | A1* | 7/2020 | Wang | H01L 27/3276 |

FOREIGN PATENT DOCUMENTS

| | | | | | |
|---|---|---|---|---|---|
| CN | 203870951 | U | | 10/2014 | |
| CN | 104200784 | A | | 12/2014 | |
| CN | 104900194 | A | | 9/2015 | |
| CN | 105869554 | A | * | 8/2016 | G06K 9/0004 |
| CN | 106157890 | A | * | 11/2016 | G06K 9/00067 |
| CN | 106157891 | A | | 11/2016 | |
| CN | 205900068 | U | | 1/2017 | |
| CN | 107274831 | A | | 10/2017 | |
| CN | 108735154 | A | | 11/2018 | |
| WO | WO-2010/101761 | A1 | | 9/2010 | |

OTHER PUBLICATIONS

International Search Report of PCT/CN2019/076015, dated May 29, 2019, 15 pages.

* cited by examiner

OPTICAL SIGNAL NOISE REDUCTION CIRCUIT, OPTICAL SIGNAL NOISE REDUCTION METHOD AND DISPLAY PANEL

CROSS-REFERENCE TO RELATED APPLICATION

The present application is the U.S. national phase of PCT Application No. PCT/CN2019/076015 filed on Feb. 25, 2019, which claims a priority of the Chinese Patent Application No. 201810550467.1 filed in China on May 31, 2018, which are incorporated herein by reference in their entirety.

TECHNICAL FIELD

The present disclosure relates to the field of optical signal noise reduction, in particular to an optical signal noise reduction circuit, an optical signal noise reduction method and a display panel.

BACKGROUND

In the related art, usually a compensation mode for a large-size Organic Light-Emitting Diode (OLED) is an external electrical compensation mode. In this mode, it is merely able to compensate for a display abnormality caused by a change in a characteristic of Thin Film Transistor (TFT), rather than a display abnormality caused by the aging of a light-emitting material. During the optical detection, it is necessary to provide an interference-free environment. During the display, changes in a gate driving signal on a gate line and a data voltage across a data line lead to a remarkably large display noise, and a small optical signal is submerged in the noise, so the display and the optical detection cannot be performed simultaneously. In addition, due to the requirement on high resolution, it is more and more difficult to provide additional time for the optical detection. There is no such a noise cancellation scheme of performing the optical detection and the display simultaneously in the related art.

SUMMARY

A main object of the present disclosure is to provide an optical signal noise reduction circuit, an optical signal noise reduction method and a display panel.

In one aspect, the present disclosure provides an optical signal noise reduction circuit, including a reference line, a comparison detection circuitry and a photoelectric signal read line. A first electric signal on the photoelectric signal read line includes a noise electric signal and a photoelectric signal. The reference line is configured to sense the noise electric signal on the photoelectric signal read line, so as to generate a corresponding second electric signal on the reference line. The comparison detection circuitry is connected to the reference line and the photoelectric signal read line, and configured to acquire the photoelectric signal in accordance with the first electric signal on the photoelectric signal read line and the second electric signal on the reference line.

In an implementation, the reference line and the photoelectric signal read line are arranged at a display region of a display panel, an extension direction of the reference line is same as an extension direction of the photoelectric signal read line, and a distance between the reference line and the photoelectric signal read line is smaller than a predetermined distance.

In an implementation, the predetermined distance is smaller than 5 μm.

In an implementation, the comparison detection circuitry includes an energy storage circuitry, an input control circuitry, a reset control circuitry, a discharging control circuitry and a voltage detection circuitry. The input control circuitry is connected to a first control line, the reference line, the photoelectric signal read line, a first end of the energy storage circuitry and a second end of the energy storage circuitry, and configured to, under the control of the first control line, control the reference line to be electrically connected to, or electrically disconnected from, the first end of the energy storage circuitry, and control the photoelectric signal read line to be electrically connected to, or electrically disconnected from, the second end of the energy storage circuitry. The reset control circuitry is connected to a second control line, the first end of the energy storage circuitry and a first voltage end, and configured to, under the control of the second control line, control the first end of the energy storage circuitry to be electrically connected to, or electrically disconnected from, the first voltage end. The discharging control circuitry is connected to a third control line, the second end of the energy storage circuitry and a second voltage end, and configured to, under the control of the third control line, control the second end of the energy storage circuitry to be electrically connected to, or electrically disconnected from, the second voltage end. The voltage detection circuitry is connected to the second end of the energy storage circuitry, and configured to detect a voltage applied to the second end of the energy storage circuitry and acquire the photoelectric signal in accordance with the voltage applied to the second end of the energy storage circuitry.

In an implementation, the energy storage circuitry includes a storage capacitor. The input control circuitry includes a first transistor and a second transistor. A gate electrode of the first transistor is connected to the first control line, a first electrode of the first transistor is connected to the reference line, and a second electrode of the first transistor is connected to a first end of the storage capacitor. A gate electrode of the second transistor is connected to the first control line, a first electrode of the second transistor is connected to the photoelectric signal read line, and a second electrode of the second transistor is connected to a second end of the storage capacitor.

In an implementation, the photoelectric signal read line is arranged at the display region of the display panel, the reference line is arranged in such a manner as to surround a peripheral region of the display region, and the optical signal noise reduction circuit further includes a noise simulation circuitry, a light-shielding member, a virtual scanning line and a reference control line arranged at the peripheral region. The noise simulation circuitry includes a virtual pixel sub-circuitry and a virtual optical detection sub-circuitry. A data write-in end of the virtual pixel sub-circuitry is connected to a corresponding data line, and a scanning control end of the virtual pixel sub-circuitry is connected to the virtual scanning line. The virtual optical detection sub-circuitry includes a virtual switching control sub-circuitry and a virtual photoelectric detection sub-circuitry. The light-shielding member is configured to prevent the virtual photoelectric detection sub-circuitry from receiving the optical signal. A control end of the virtual switching control sub-circuitry is connected to the reference control line, a first end of the virtual switching control sub-circuitry is connected to an output end of the virtual photoelectric detection sub-circuitry, and a second end of the virtual switching control sub-circuitry is connected to the reference line.

In an implementation, a gate driving signal on a gate line is used to apply a virtual scanning signal to the virtual scanning line.

In an implementation, the comparison detection circuitry includes an energy storage circuitry, an input control circuitry, a reset control circuitry, a discharging control circuitry and a voltage detection circuitry. The reference line is connected to a first end of the energy storage circuitry. The input control circuitry is connected to a first control line, the photoelectric signal read line and a second end of the energy storage circuitry, and configured to, under the control of the first control line, control the photoelectric signal read line to be electrically connected to, or electrically disconnected from, the second end of the energy storage circuitry. The reset control circuitry is connected to a second control line, the first end of the energy storage circuitry and a first voltage end, and configured to, under the control of the second control line, control the first end of the energy storage circuitry to be electrically connected to, or electrically disconnected from, the first voltage end. The discharging control circuitry is connected to a third control line, the second end of the energy storage circuitry and a second voltage end, and configured to, under the control of the third control line, control the second end of the energy storage circuitry to be electrically connected to, or electrically disconnected from, the second voltage end. The voltage detection circuitry is connected to the second end of the energy storage circuitry, and configured to detect a voltage applied to the second end of the energy storage circuitry and acquire the photoelectric signal in accordance with the voltage applied to the second end of the energy storage circuitry.

In an implementation, the energy storage circuitry includes a storage capacitor, a first end of which is connected to the reference line. The input control circuitry includes a third transistor, a gate electrode of which is connected to the first control line, a first electrode of which is connected to the photoelectric signal read line, and a second electrode of which is connected to a second end of the storage capacitor.

In an implementation, the reset control circuitry includes a reset control transistor, a gate electrode of which is connected to the second control line, a first electrode of which is connected to the first end of the storage capacitor, and a second electrode of which is connected to the first voltage end. The discharging control circuitry includes a discharging control transistor, a gate electrode of which is connected to the third control line, a first electrode of which is connected to the second end of the storage capacitor, and a second electrode of which is connected to the second voltage end.

In an implementation, the voltage detection circuitry includes a source follower transistor, a current source and a voltage detection sub-circuitry. A gate electrode of the source follower transistor is connected to the second end of the storage capacitor, a first electrode of the source follower transistor is connected to a third voltage end, and a second electrode of the source follower transistor is connected to an output node. A first end of the current source is connected to the output node, and a second end of the current source is connected to a fourth voltage end. The current source is configured to supply a bias current flowing from the output node to the fourth voltage end. The voltage detection sub-circuitry is connected to the output node, and configured to detect a potential at the output node and acquire the photoelectric signal in accordance with the potential at the output node.

In an implementation, the virtual pixel sub-circuitry includes a virtual data write-in sub-circuitry, a virtual driving sub-circuitry and a virtual light-emitting element. A control end of the virtual data write-in sub-circuitry is the scanning control end of the virtual pixel sub-circuitry, a first end of the virtual data write-in sub-circuitry is the data write-in end of the virtual pixel sub-circuitry, and a second end of the virtual data write-in sub-circuitry is a control end of the virtual driving sub-circuitry. The virtual data write-in sub-circuitry is configured to, under the control of the virtual scanning line, control the corresponding data line to be electrically connected to, or electrically disconnected from, the control end of the virtual driving sub-circuitry. A first end of the virtual driving sub-circuitry is connected to a high voltage end, a second end of the virtual driving sub-circuitry is connected to a first electrode of the virtual light-emitting element, and a second electrode of the virtual light-emitting element is connected to a low voltage end.

In an implementation, the comparison detection circuitry includes an energy storage circuitry, an input control circuitry, a reset control circuitry, a discharging control circuitry and a voltage detection circuitry. The input control circuitry is directly connected to a first control line, the reference line, the photoelectric signal read line, a first end of the energy storage circuitry and a second end of the energy storage circuitry, and configured to, under the control of the first control line, control the reference line to be electrically connected to, or electrically disconnected from, the first end of the energy storage circuitry, and control the photoelectric signal read line to be electrically connected to, or electrically disconnected from, the second end of the energy storage circuitry. The reset control circuitry is directly connected to a second control line, the first end of the energy storage circuitry and a first voltage end, and configured to, under the control of the second control line, control the first end of the energy storage circuitry to be electrically connected to, or electrically disconnected from, the first voltage end. The discharging control circuitry is directly connected to a third control line, the second end of the energy storage circuitry and a second voltage end, and configured to, under the control of the third control line, control the second end of the energy storage circuitry to be electrically connected to, or electrically disconnected from, the second voltage end. The voltage detection circuitry is directly connected to the second end of the energy storage circuitry, and configured to detect a voltage applied to the second end of the energy storage circuitry and acquire the photoelectric signal in accordance with the voltage applied to the second end of the energy storage circuitry.

In an implementation, the energy storage circuitry includes a storage capacitor. The input control circuitry includes a first transistor and a second transistor. A gate electrode of the first transistor is directly connected to the first control line, a first electrode of the first transistor is directly connected to the reference line, and a second electrode of the first transistor is directly connected to a first end of the storage capacitor. A gate electrode of the second transistor is directly connected to the first control line, a first electrode of the second transistor is directly connected to the photoelectric signal read line, and a second electrode of the second transistor is directly connected to a second end of the storage capacitor.

In an implementation, the photoelectric signal read line is arranged at the display region of the display panel, the reference line is arranged in such a manner as to surround a peripheral region of the display region, and the optical signal noise reduction circuit further includes a noise simulation circuitry, a light-shielding member, a virtual scanning line and a reference control line arranged at the peripheral region. The noise simulation circuitry includes a virtual pixel sub-circuitry and a virtual optical detection sub-circuitry. A data write-in end of the virtual pixel sub-circuitry is directly connected to a corresponding data line, and a scanning control end of the virtual pixel sub-circuitry is directly connected to the virtual scanning line. The virtual optical detection sub-circuitry includes a virtual switching control sub-circuitry and a virtual photoelectric detection sub-circuitry. The light-shielding member is configured to prevent the virtual photoelectric detection sub-circuitry from receiving the optical signal. A control end of the virtual switching control sub-circuitry is directly connected to the reference control line, a first end of the virtual switching control sub-circuitry is directly connected to an output end of the virtual photoelectric detection sub-circuitry, and a second end of the virtual switching control sub-circuitry is directly connected to the reference line.

In an implementation, the comparison detection circuitry includes an energy storage circuitry, an input control circuitry, a reset control circuitry, a discharging control circuitry and a voltage detection circuitry. The reference line is directly connected to a first end of the energy storage circuitry. The input control circuitry is directly connected to a first control line, the photoelectric signal read line and a second end of the energy storage circuitry, and configured to, under the control of the first control line, control the photoelectric signal read line to be electrically connected to, or electrically disconnected from, the second end of the energy storage circuitry. The reset control circuitry is directly connected to a second control line, the first end of the energy storage circuitry and a first voltage end, and configured to, under the control of the second control line, control the first end of the energy storage circuitry to be electrically connected to, or electrically disconnected from, the first voltage end. The discharging control circuitry is directly connected to a third control line, the second end of the energy storage circuitry and a second voltage end, and configured to, under the control of the third control line, control the second end of the energy storage circuitry to be electrically connected to, or electrically disconnected from, the second voltage end. The voltage detection circuitry is directly connected to the second end of the energy storage circuitry, and configured to detect a voltage applied to the second end of the energy storage circuitry and acquire the photoelectric signal in accordance with the voltage applied to the second end of the energy storage circuitry.

In an implementation, the energy storage circuitry includes a storage capacitor, a first end of which is directly connected to the reference line. The input control circuitry includes a third transistor, a gate electrode of which is directly connected to the first control line, a first electrode of which is directly connected to the photoelectric signal read line, and a second electrode of which is directly connected to a second end of the storage capacitor.

In an implementation, the reset control circuitry includes a reset control transistor, a gate electrode of which is directly connected to the second control line, a first electrode of which is directly connected to the first end of the storage capacitor, and a second electrode of which is directly connected to the first voltage end. The discharging control circuitry includes a discharging control transistor, a gate electrode of which is directly connected to the third control line, a first electrode of which is directly connected to the second end of the storage capacitor, and a second electrode of which is directly connected to the second voltage end.

In an implementation, the voltage detection circuitry includes a source follower transistor, a current source and a voltage detection sub-circuitry. A gate electrode of the source follower transistor is directly connected to the second end of the storage capacitor, a first electrode of the source follower transistor is directly connected to a third voltage end, and a second electrode of the source follower transistor is directly connected to an output node. A first end of the current source is directly connected to the output node, and a second end of the current source is directly connected to a fourth voltage end. The current source is configured to supply a bias current flowing from the output node to the fourth voltage end. The voltage detection sub-circuitry is directly connected to the output node, and configured to detect a potential at the output node and acquire the photoelectric signal in accordance with the potential at the output node.

In an implementation, the virtual pixel sub-circuitry includes a virtual data write-in sub-circuitry, a virtual driving sub-circuitry and a virtual light-emitting element. A control end of the virtual data write-in sub-circuitry is the scanning control end of the virtual pixel sub-circuitry, a first end of the virtual data write-in sub-circuitry is the data write-in end of the virtual pixel sub-circuitry, and a second end of the virtual data write-in sub-circuitry is a control end of the virtual driving sub-circuitry. The virtual data write-in sub-circuitry is configured to, under the control of the virtual scanning line, control the corresponding data line to be electrically connected to, or electrically disconnected from, the control end of the virtual driving sub-circuitry. A first end of the virtual driving sub-circuitry is directly connected to a high voltage end, a second end of the virtual driving sub-circuitry is directly connected to a first electrode of the virtual light-emitting element, and a second electrode of the virtual light-emitting element is directly connected to a low voltage end.

In another aspect, the present disclosure provides in some embodiments an optical signal noise reduction method for the above-mentioned optical signal noise reduction circuit, including, at a corresponding line scanning stage, supplying power to a corresponding gate line connected to a pixel circuit, and enabling a comparison detection circuitry to acquire a photoelectric signal in accordance with a first electric signal on a corresponding photoelectric signal read line and a second electric signal on a reference line.

In an implementation, the reference line and the photoelectric signal read line are arranged at a display region of a display panel, an extension direction of the reference line is same as an extension direction of the photoelectric signal read line, and a distance between the reference line and the photoelectric signal read line is smaller than a predetermined distance. The comparison detection circuitry includes an energy storage circuitry, an input control circuitry, a reset control circuitry, a discharging control circuitry and a voltage detection circuitry. The corresponding line scanning stage includes an input time period and a detection time period arranged one after another in that order. The optical signal noise reduction method includes: within the input time period of the corresponding line scanning stage, controlling, by the input control circuitry, the reference line to be electrically connected to a first end of the energy storage circuitry and controlling, by the input control circuitry, the photoelectric signal read line to be electrically connected to a second end of the energy storage circuitry under the control of a first control line, to charge the energy storage circuitry through the second electric signal on the reference line and the first electric signal on the photoelectric signal read line, thereby to enable a difference between a voltage applied to the second end of the energy storage circuitry and a voltage applied to the first end of the energy storage circuitry to be a photoelectric signal, and controlling, by the reset control circuitry, the first end of the energy storage circuitry to be electrically disconnected from a first voltage end under the control of a second control line; and within the detection time period of the corresponding line scanning stage, detecting, by the voltage detection circuitry, the photoelectric signal, controlling, by the input control circuitry, the reference line to be electrically disconnected from the first end of the energy storage circuitry and controlling, by the input control circuitry, the photoelectric signal read line to be electrically disconnected from the second end of the energy storage circuitry under the control of the first control line, controlling, by the reset control circuitry, the first end of the energy storage circuitry to be electrically connected to the first voltage end under the control of the second control line, and controlling, by the discharging control circuitry, the second end of the energy storage circuitry to be electrically disconnected from a second voltage end under the control of a third control line.

In yet another aspect, the present disclosure provides in some embodiments a display panel, including Pixel circuits arranged in N columns and N optical signal noise reduction circuits each corresponding to the pixel circuits in one column, N being a positive integer greater than 1, and n being a positive integer smaller than or equal to N. Each pixel circuit is arranged at a display region of the display panel. A comparison detection circuitry of the optical signal noise reduction circuit is arranged a peripheral region surrounding the display region of the display panel. A reference line and a photoelectric signal read line of the optical signal noise reduction circuit are arranged at the display region, an extension direction of the reference line is same as an extension direction of the photoelectric signal read line, and a distance between the reference line and the photoelectric signal read line is smaller than a predetermined distance; or the reference line is arranged at the peripheral region, the optical signal noise reduction circuit further includes a noise simulation circuitry, a light-shielding member, a virtual scanning line and a reference control line arranged at the peripheral region, and the noise simulation circuitry is of a same structure as the pixel circuit.

DETAILED DESCRIPTION

In the following, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

All transistors adopted in the embodiments of the present disclosure may be TFTs, Field Effect Transistors (FETs) or other elements having an identical characteristic. In the embodiments of the present disclosure, in order to differentiate two electrodes other than a gate electrode from each other, one of the two electrodes is called as first electrode and the other is called as second electrode. In actual use, the first electrode may be a drain electrode while the second electrode may be a source electrode, or the first electrode may be a source electrode while the second electrode may be a drain electrode.

The present disclosure provides in some embodiments an optical signal noise reduction circuit which includes a reference line, a comparison detection circuitry and a photoelectric signal read line. An electric signal on the photoelectric signal read line includes a noise electric signal and a photoelectric signal. The reference line is configured to sense the noise electric signal on the photoelectric signal read line, so as to generate a corresponding second electric signal on the reference line. The comparison detection circuitry is connected to the reference line and the photoelectric signal read line, and configured to acquire the photoelectric signal in accordance with the electric signal on the photoelectric signal read line and the electric signal on the reference line.

According to the optical signal noise reduction circuit in the embodiments of the present disclosure, the comparison detection circuitry may acquire the photoelectric signal in accordance with the electric signal on the photoelectric signal read line and the electric signal on the reference line. As a result, it is able to perform the optical detection and the display simultaneously, thereby to reduce a time period for the optical detection while eliminating a noise.

During the implementation, the reference line is configured to sense the noise electric signal on the photoelectric signal read line, so as to generate the corresponding electric signal, i.e., there is only a small difference between a value of the electric signal on the reference line and a value of the noise electric signal. The electric signal on the reference line may be of a same type as the electric signal on the photoelectric signal read line.

Figure 1:
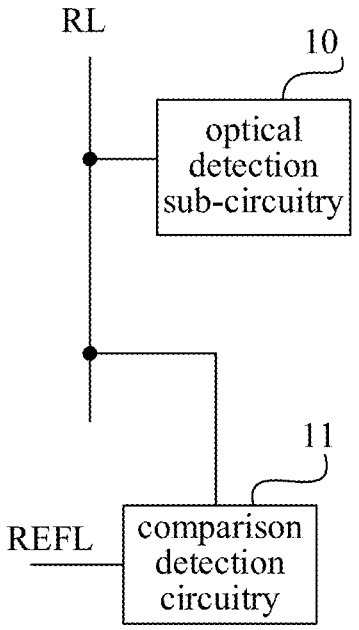
FIG. 1 is a schematic view showing an optical signal noise reduction circuit according to an embodiment of the present disclosure.

The optical signal noise reduction circuit in the embodiments of the present disclosure may be applied to a pixel circuit. As shown in FIG. 1, the pixel circuit may include an optical detection sub-circuitry 10 connected to a photoelectric signal read line RL. The optical signal noise reduction circuit may include a reference line REFL, a comparison detection circuitry 11 and the photoelectric signal read line RL. An electric signal on the photoelectric signal read line RL may include a noise electric signal and a photoelectric signal. The reference line REFL is configured to sense the noise electric signal on the photoelectric signal read line RL, so as to generate a corresponding electric signal. There is only a small difference between a value of the electric signal on the reference line REFL and a value of the noise electric signal. The electric signal on the reference line REFL may be of a same type as the electric signal on the photoelectric signal read line RL. The comparison detection circuitry 11 is connected to the reference line REFL and the photoelectric signal read line RL, and configured to acquire the photoelectric signal in accordance with the electric signal on the photoelectric signal read line RL and the electric signal on the reference line REFL.

According to the optical signal noise reduction circuit in the embodiments of the present disclosure, the comparison detection circuitry 11 may acquire the photoelectric signal in accordance with the electric signal on the photoelectric signal read line RL and the electric signal on the reference line REFL. As a result, it is able to perform the optical detection and the display simultaneously, thereby to reduce a time period for the optical detection while eliminating a noise.

In actual use, the electric signal on the reference line REFL may be the noise electric signal generated due to the interference caused by a gate line and a data line, and the electric signal on the photoelectric signal read line RL may include the noise electric signal and the photoelectric signal.

During the implementation, the electric signal on the reference line REFL may be of a same type as the electric signal on the photoelectric signal read line RL, i.e., the electric signal on REFL and the electric signal on RL may each be a voltage signal. At this time, an absolute value of a difference between a voltage value of the voltage signal on REFL and a voltage value of a noise voltage signal included in the voltage signal on RL may be smaller than a predetermined voltage difference (in actual use, the predetermined voltage difference may be set according to the practical need, e.g., it may be, but not limited to, 0.1V). Alternatively, the electric signal on REFL and the electric signal on RL may each be a current signal. At this time, an absolute value of a difference between a current value of the current signal on REFL and a current value of a noise current signal included in the current signal on RL may be smaller than a predetermined current difference (in actual use, the predetermined current difference may be set according to the practical need, e.g., it may be, but not limited to, 0.05A). Alternatively, the electric signal on REFL and the electric signal on RL may each be a charge signal. At this time, an absolute value of a difference between a charge amount of the charge signal on REFL and a charge amount of a noise charge signal included in the charge signal on RL may be smaller than a predetermined charge amount difference (in actual use, the predetermined charge amount difference may be set according to the practical need).

During the implementation, the pixel circuit may further include a pixel sub-circuitry, a scanning control end of which is connected to the corresponding gate line, and a data write-in end of which is connected to the corresponding data line.

In a possible embodiment of the present disclosure, the reference line REFL and the photoelectric signal read line RL may be arranged at a display region of a display panel, the reference line REFL may extend in a same direction as the photoelectric signal read line RL, and a distance between the reference line REFL and the photoelectric signal read line RL may be smaller than a predetermined distance. It should be appreciated that, when the distance between REFL and RL is smaller than the predetermined distance, it means that the reference line REFL is located immediately adjacent to the photoelectric signal read line RL, and the predetermined distance may be set according to the practical need, e.g., the predetermined distance may be 1 μm, as long as the reference line REFL is capable of effectively sensing the noise electric signal on the photoelectric signal read line RL. In the embodiments of the present disclosure, through the additional reference line REFL located immediately adjacent to the photoelectric signal read line RL, the noise electric signal on the reference line REFL may be approximately the same as the noise electric signal on the photoelectric signal read line RL.

In a possible embodiment of the present disclosure, the predetermined distance may be smaller than 5 μm, so that the reference line REFL is located immediately adjacent to the photoelectric signal read line RL.

In actual use, the reference line is arranged immediately adjacent to the photoelectric signal read line at the display region. Usually, a photoelectric signal read line in a column is shared by the pixel circuits in a column, so the reference line immediately adjacent to the photoelectric signal read line may have a same length as the photoelectric signal read line, and the reference line may be arranged parallel to the photoelectric signal read line.

In another possible embodiment of the present disclosure, the photoelectric signal read line may be arranged at the display region of the display panel, and the reference line may be arranged at a peripheral region surrounding the display region. The optical signal noise reduction circuit may further include a noise simulation circuitry, a light-shielding member, a virtual scanning line and a reference control line arranged at the peripheral region. The noise simulation circuitry may include a virtual pixel sub-circuitry and a virtual optical detection sub-circuitry. A data write-in end of the virtual pixel sub-circuitry may be connected to the data line, and a scanning control end of the virtual pixel sub-circuitry may be connected to the virtual scanning line. The virtual optical detection sub-circuitry may include a virtual switching control sub-circuitry and a virtual photoelectric detection sub-circuitry. The light-shielding member is configured to prevent the virtual photoelectric detection sub-circuitry from receiving the optical signal. A control end of the virtual switching control sub-circuitry may be connected to the reference control line, a first end of the virtual switching control sub-circuitry may be connected to an output end of the virtual photoelectric detection sub-circuitry, and a second end of the virtual switching control sub-circuitry may be connected to the reference line.

In actual use, the noise simulation circuitry (a structure of which will be described hereinafter in conjunction with the drawings) may be arranged at the peripheral region corresponding to the pixel circuits in a column, so as to simulate the noise electric signal on the photoelectric signal read line. A virtual scanning signal on the virtual scanning line may be the same as a gate driving signal on the gate line, and the data write-in end of the virtual pixel sub-circuitry of the noise simulation circuitry may also be connected to the data line. Hence, the noise electric signal on the reference line connected to the noise simulation circuitry may be approximately the same as the noise electric signal on the photoelectric signal read line.

During the implementation, a data voltage across the data line connected to the virtual pixel sub-circuitry may be the same as a data voltage applied to the corresponding pixel circuit, and the virtual scanning signal on the virtual scanning line connected to the virtual pixel sub-circuitry may be the same as the gate driving signal on the gate line. The virtual pixel sub-circuitry may be arranged at the peripheral region, and it is configured to simulate the noise electric signal generated due to the interference caused by the gate line and the data line on the photoelectric signal read line, rather than to emit light for display.

Figure 2:
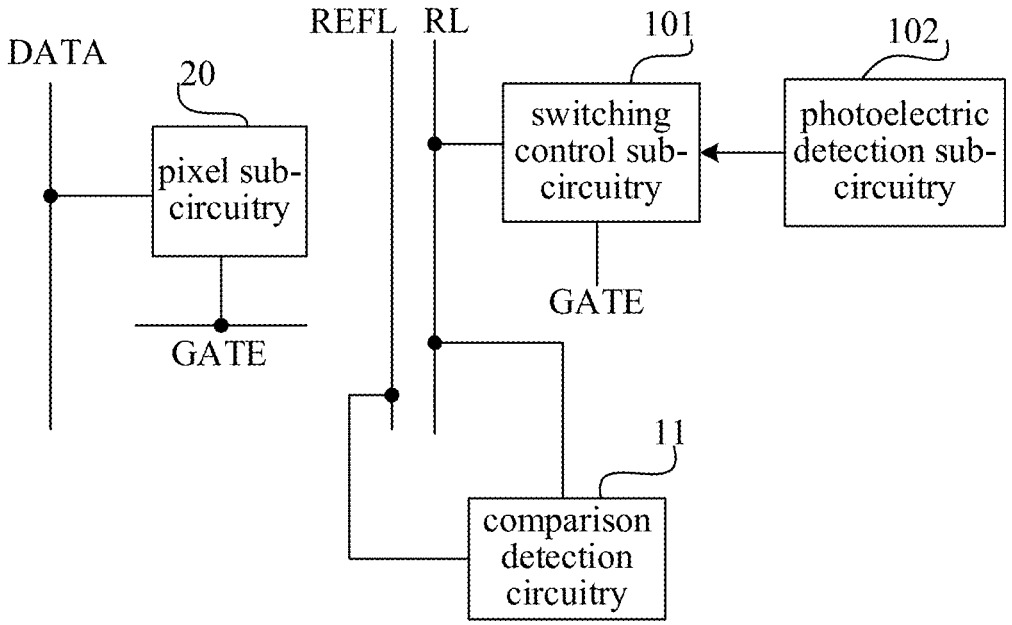
FIG. 2 is a schematic view showing an optical signal noise reduction circuit according to another embodiment of the present disclosure.

As shown in FIG. 2, the pixel circuit may include a pixel sub-circuitry 20 and an optical detection sub-circuitry. A scanning control end of the pixel sub-circuitry 20 may be connected to a gate line GATE, and a data write-in end of the pixel sub-circuitry may be connected to a data line DATA. The optical detection sub-circuitry may include a switching control sub-circuitry 101 and a photoelectric detection sub-circuitry 102. A control end of the switching control sub-circuitry 101 may be connected to the gate line GATE, a first end of the switching control sub-circuitry 101 may be connected to an output end of the photoelectric detection sub-circuitry 102, and a second end of the switching control sub-circuitry 101 may be connected to a photoelectric signal read line RL. The photoelectric signal read line RL may be arranged at a display region of the display panel.

The optical signal noise reduction circuit in the embodiments of the present disclosure may be applied to the pixel circuit, and it may include the reference line REFL, the comparison detection circuitry 11 and the photoelectric signal read line RL. The reference line REFL may be arranged immediately adjacent to the data line DATA, and an interference caused by GATE and DATA on REFL may be the same as an interference caused by GATE and DATA on RL. The reference line REFL may be arranged at the display region and extend in a same direction as the photoelectric signal read line RL, and a distance between the reference line REFL and the photoelectric signal read line RL may be smaller than a predetermined distance. The comparison detection circuitry 11 may be connected to the reference line REFL and the photoelectric signal read line RL, and configured to acquire a photoelectric signal in accordance with an electric signal on the photoelectric signal read line RL and an electric signal on the reference line REFL.

Figure 3:
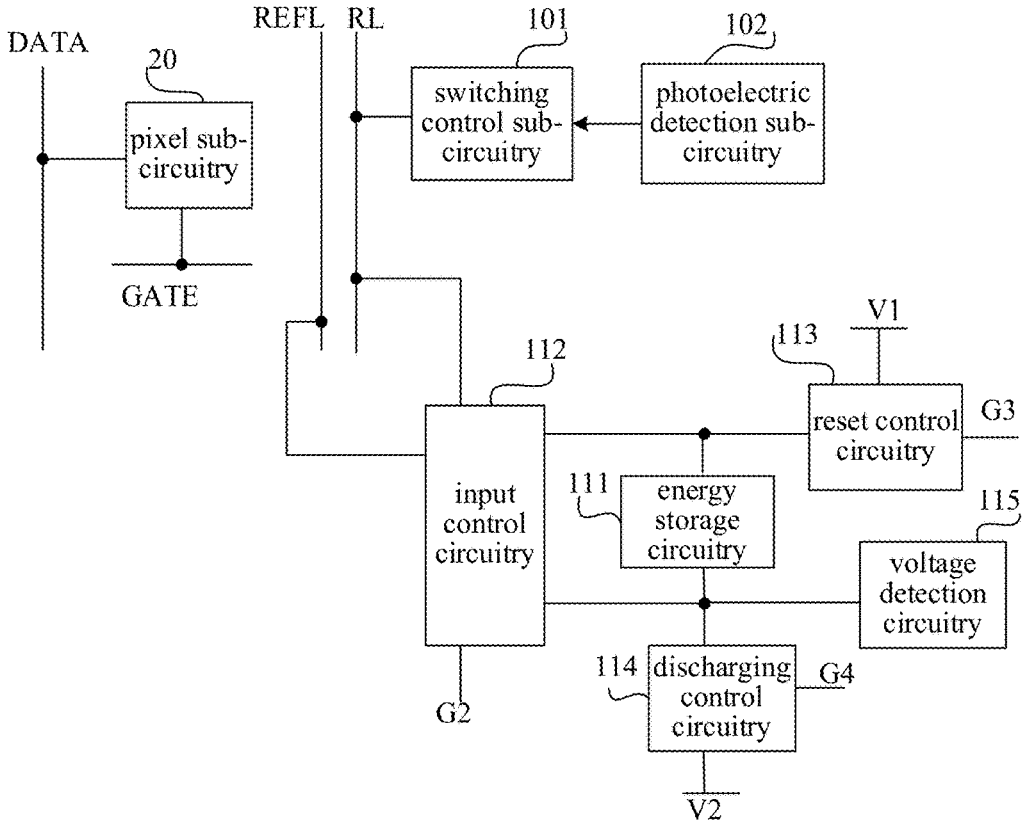
FIG. 3 is a schematic view showing an optical signal noise reduction circuit according to yet another embodiment of the present disclosure.

Based on the optical signal noise reduction circuit in FIG. 2, as shown in FIG. 3, the comparison detection circuitry may include an energy storage circuitry 111, an input control circuitry 112, a reset control circuitry 113, a discharging control circuitry 114 and a voltage detection circuitry 115.

The input control circuitry 112 may be connected to a first control line G2, the reference line REFL, the photoelectric signal read line RL, a first end of the energy storage circuitry 111 and a second end of the energy storage circuitry 111, and configured to, under the control of the first control line G2, control the reference line REFL to be electrically connected to, or electrically disconnected from, the first end of the energy storage circuitry 111, and control the photoelectric signal read line RL to be electrically connected to, or electrically disconnected from, the second end of the energy storage circuitry 111.

The reset control circuitry 113 may be connected to a second control line G3, the first end of the energy storage circuitry 111 and a first voltage end, and configured to, under the control of the second control line G2, control the first end of the energy storage circuitry 111 to be electrically connected to, or electrically disconnected from, the first voltage end. The first voltage end is configured to apply a first voltage V1. The discharging control circuitry 114 may be connected to a third control line G4, the second end of the energy storage circuitry 111 and a second voltage end, and configured to, under the control of the third control line G4, control the second end of the energy storage circuitry 111 to be electrically connected to, or electrically disconnected from, the second voltage end. The second voltage end is configured to apply a second voltage V2. The voltage detection circuitry 115 may be connected to the second end of the energy storage circuitry 111, and configured to detect a voltage applied to the second end of the energy storage circuitry 111 and acquire the photoelectric signal in accordance with the voltage applied to the second end of the energy storage circuitry 111.

During the implementation, the first voltage V1 and the second voltage V2 may each be, but not limited to, a low voltage.

To be specific, the energy storage circuitry may include a storage capacitor. The input control circuitry may include a first transistor and a second transistor. A gate electrode of the first transistor may be connected to the first control line, a first electrode of the first transistor may be connected to the reference line, and a second electrode of the first transistor may be connected to the first end of the storage capacitor. A gate electrode of the second transistor may be connected to the first control line, a first electrode of the second transistor may be connected to the photoelectric signal read line, and a second electrode of the second transistor may be connected to a second end of the storage capacitor.

To be specific, the reset control circuitry may include a reset control transistor, a gate electrode of which is connected to the second control line, a first electrode of which is connected to the first end of the storage capacitor, and a second electrode of which is connected to the first voltage end. The discharging control circuitry may include a discharging control transistor, a gate electrode of which is connected to the third control line, a first electrode of which is connected to the second end of the storage capacitor, and a second electrode of which is connected to the second voltage end.

To be specific, the voltage detection circuitry may include a source follower transistor, a current source and a voltage detection sub-circuitry. A gate electrode of the source follower transistor may be connected to the second end of the storage capacitor, a first electrode of the source follower transistor may be connected to a third voltage end, and a second electrode of the source follower transistor may be connected to an output node. A first end of the current source may be connected to the output node, and a second end of the current source may be connected to a fourth voltage end. The current source is configured to supply a bias current flowing from the output node to the fourth voltage end. The voltage detection sub-circuitry may be connected to the output node, and configured to detect a potential at the output node and acquire the photoelectric signal in accordance with the potential at the output node.

In actual use, the third voltage end may be, but not limited to, a high voltage end, and the fourth voltage end may be, but not limited to, a low voltage end.

During the operation of the optical signal noise reduction circuit in FIG. 3, within an input time period of a corresponding line scanning stage, the pixel sub-circuitry 20 may start to emit light, and the photoelectric detection sub-circuitry 102 may convert an optical signal from the pixel sub-circuitry 20 into a corresponding photoelectric signal. The switching control sub-circuitry 101 may control the output end of the photoelectric detection sub-circuitry 102 to be electrically connected to the photoelectric signal read line RL. Under the control of the first control line G2, the input control circuitry 112 may control the reference line REFL to be electrically connected to the first end of the energy storage circuitry 111, and control the photoelectric signal read line RL to be electrically connected to the second end of the energy storage circuitry 111, so as to charge the electric signal of the energy storage circuitry 111 through the electric signal on the reference line REFL and the electric signal on the photoelectric signal read line RL, thereby to acquire a difference between the voltage applied to the second end of the energy storage circuitry 111 and the voltage applied to the first end of the energy storage circuitry 111 as the photoelectric signal. Under the control of the second control line G3, the reset control circuitry 113 may control the first end of the energy storage circuitry 111 to be electrically disconnected from the first voltage end.

Within a detection time period of the corresponding line scanning stage, the voltage detection circuitry 115 may detect the photoelectric signal. Under the control of the first control line G2, the input control circuitry 112 may control the reference line REFL to be electrically disconnected from the first end of the energy storage circuitry 111, and control the photoelectric signal read line RL to be electrically disconnected from the second end of the energy storage circuitry 111. Under the control of the second control line G3, the reset control circuitry 113 may control the first end of the energy storage circuitry 111 to be electrically connected to the first voltage end. Under the control of the third control line G4, the discharging control circuitry 114 may control the second end of the energy storage circuitry 111 to be electrically disconnected from the second voltage end.

Within a resetting time period of the corresponding line scanning stage, under the control of the first control line G2, the input control circuitry 112 may control the reference line REFL to be electrically connected to the first end of the energy storage circuitry 111, and control the photoelectric signal read line RL to be electrically connected to the second end of the energy storage circuitry 111. Under the control of the third control line G4, the discharging control circuitry 114 may control the second end of the energy storage circuitry 111 to be electrically connected to the second voltage end, so as to discharge the energy storage circuitry 111, and reset a potential at the output end of the photoelectric detection sub-circuitry 102 through the photoelectric signal read line RL.

The optical signal noise reduction circuit will be described hereinafter in more details.

Figure 4:
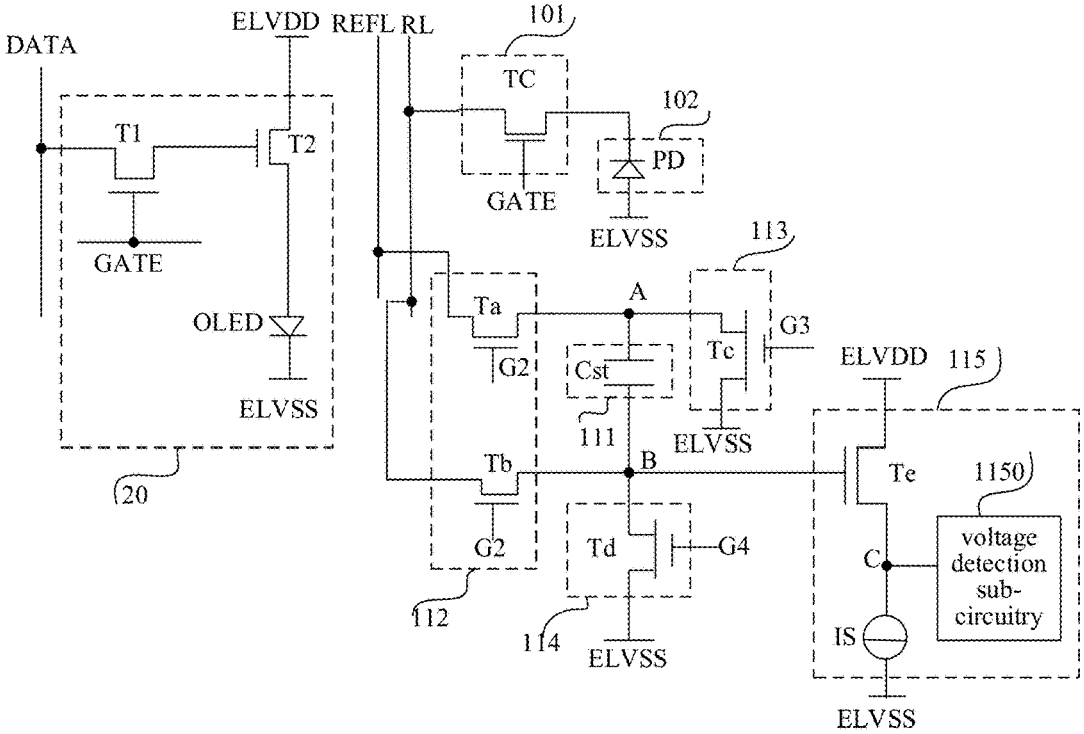
FIG. 4 is a circuit diagram of the optical signal noise reduction circuit according to an embodiment of the present disclosure.

The optical signal noise reduction circuit in the embodiments of the present disclosure may be applied to a pixel circuit. As shown in FIG. 4, the pixel circuit may include the pixel sub-circuitry 20 and the optical detection sub-circuitry. The pixel sub-circuitry 20 may include a data write-in transistor T1, a driving transistor T2 and an OLED. A source electrode of T1 may be connected to the data line DATA, and a gate electrode of T1 may be connected to the gate line GATE. A gate electrode of T2 may be connected to a drain electrode of T1, a drain electrode of T2 may be connected to a high voltage end ELVDD, a source electrode of T2 may be connected to an anode of the OLED, and a cathode of the OLED may be connected to a low voltage end ELVSS.

The optical detection sub-circuitry may include the switching control sub-circuitry 101 and the photoelectric detection sub-circuitry 102. The switching control sub-circuitry 101 may include a switching control transistor TC, a gate electrode of which may be connected to the gate line GATE, and a source electrode of which may be connected to the photoelectric signal read line RL. The photoelectric detection sub-circuitry 102 may include a photodiode PD, an anode of which may be connected to the low voltage end ELVSS, and a cathode of which may be connected to a drain electrode of TC.

In this embodiment of the present disclosure, the optical signal noise reduction circuit may include the reference line REFL, the photoelectric signal read line RL and the comparison detection circuitry. The reference line REFL may extend in a same direction as the photoelectric signal read line RL, and a distance between the reference line REFL and the photoelectric signal read line RL may be smaller than a predetermined distance (i.e., REFL may be located immediately adjacent to RL).

The pixel sub-circuitry 20, the optical detection sub-circuitry 10 and the reference line REFL may be arranged at the display region of the display panel, and the comparison detection circuitry may be arranged at the peripheral region surrounding the display region of the display panel.

The comparison detection circuitry may include the energy storage circuitry 111, the input control circuitry 112, the reset control circuitry 113, the discharging control circuitry 114 and the voltage detection circuitry 115. The energy storage circuitry 111 may include a storage capacitor Cst. The input control circuitry 112 may include a first transistor Ta and a second transistor Tb. A gate electrode of the first transistor Ta may be connected to the first control line G2, a drain electrode of the first transistor Ta may be connected to the reference line REFL, and a source electrode of the first transistor Ta may be connected to a first end A of the storage capacitor Cst. A gate electrode of the second transistor Tb may be connected to the first control line G2, a drain electrode of the second transistor Tb may be connected to the photoelectric signal read line RL, and a source electrode of the second transistor Tb may be connected to a second end B of the storage capacitor Cst.

The reset control circuitry 113 may include a reset control transistor Tc, a gate electrode of which is connected to the second control line G3, a drain electrode of which is connected to the first end A of the storage capacitor Cst, and a source electrode of which is connected to the low voltage end ELVSS. The discharging control circuitry 114 may include a discharging control transistor Td, a gate electrode of which is connected to the third control line G4, a drain electrode of which is connected to the second end B of the storage capacitor Cst, and a source electrode of which is connected to the low voltage end ELVSS.

The voltage detection circuitry 115 may include a source follower transistor Te, a current source IS and a voltage detection sub-circuitry 1150. A gate electrode of the source follower transistor Te may be connected to the second end B of the storage capacitor Cst, a drain electrode of the source follower transistor Te may be connected to the high voltage end ELVDD, and a source electrode of the source follower transistor Te may be connected to an output node C. A first end of the current source IS may be connected to the output node C, and a second end of the current source IS may be connected to the low voltage end ELVSS. The current source IS is configured to supply a bias current flowing from the output node C to the low voltage end ELVSS. The bias current is used for the operation of the source follower transistor T2. The voltage detection sub-circuitry 1150 may be connected to the output node C, and configured to detect a potential at the output node C and acquire the photoelectric signal in accordance with the potential at the output node C.

In the embodiment of FIG. 4, all the transistors are n-type transistors. However, in actual use, the transistors may also be p-type transistors, i.e., the types of the transistors will not be particularly defined herein.

In the embodiment of FIG. 4, when Te is in a saturation state, $\Delta Vs=(gm\times Ro)\times\Delta Vg/(1+gm\times Ro)$, where Ro represents an equivalent resistance of the current source IS, gm represents a transconductance of the source follower transistor Te, ΔVs represents a change in a voltage applied to the source electrode of Te, and ΔVg represents a change in a voltage applied to the gate electrode of Te. When gm×Ro is sufficiently large, ΔVs may be approximately equal to ΔVg. Based on the above equation, a following coefficient sg of the source follower transistors Te may be equal to $(gm\times Ro)\times/(1+gm\times Ro)$.

In the embodiment of FIG. 4, gm and Ro may each be provided with a sufficiently large value, so as to enable sg to be approximately equal to 1, and enable ΔVs to be approximately equal to ΔVg.

Figure 5:
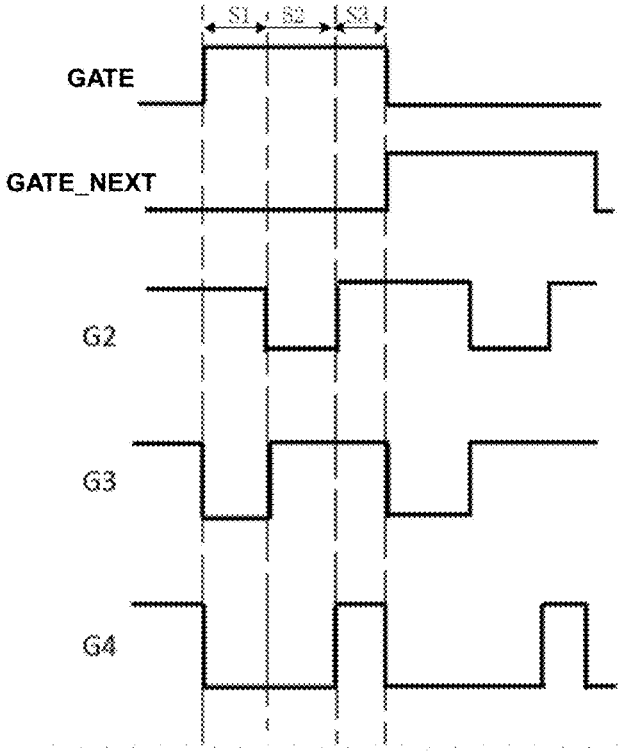
FIG. 5 is an operation sequence diagram of the optical signal noise reduction circuit in FIG. 4 according to an embodiment of the present disclosure.

As shown in FIG. 5, during the operation of the optical signal noise reduction circuit in FIG. 4, the corresponding line scanning stage may include an input time period S1, a detection time period S2 and a resetting time period S3 arranged in that order.

Within the input time period S1 of the corresponding line scanning stage, GATE may output a high level, so as to enable OLED to emit light. PD may sense an optical signal from OLED, and convert the optical signal into a photoelectric signal. G2 may output a high level, G3 may output a low level, and G4 may output a low level, so as to turn on Ta and Tb, and turn off Tc and Td. Cst may be charged through the noise current signal on REFL and the photo current signal including the noise current signal on RL. At this time, a voltage applied to the first end A of Cst may be a noise voltage, and a voltage applied to the second end B of Cst may include a noise voltage and a photo voltage. Hence, a difference between the voltage applied to the second end B of Cst and the voltage applied to the first end A of Cst may be equal to the photo voltage. Within the input time period S1, Te may operate in the saturation state.

Within the detection time period S2 of the line scanning stage, GATE may output a high level, and a value of a low voltage applied by ELVSS may be 0. G2 may output a low voltage, G3 may output a high voltage, and G4 may output a low voltage, so as to turn off Ta, Tb and Td, and turn on Tc, so the voltage applied to the first end A of Cst may be 0. A difference between the voltages applied to two ends of Cst cannot change suddenly, so the voltage applied to the second end B of Cst may be just the photo voltage. At this time, Te may operate in the saturation stage. The voltage detection circuitry 115 may detect a voltage Vs applied to the source electrode of T2, and subtract an initial source voltage (i.e., a voltage applied to the source electrode of Te detected by the voltage detection circuitry 115 before S1 (i.e., at a moment immediately before S1)) from Vs, so as to acquire a voltage difference being equal to the photo voltage.

Within the resetting time period S3 of the corresponding line scanning stage, GATE may output a high level, and G2, G3 and G4 may each output a high level, so as to turn on Ta, Tb, Tc, Td and TC, thereby to reset the voltages applied to the first end A and the second B of Cst, a voltage across REFL, a voltage across RL, and a voltage applied to the cathode of PD.

In FIG. 5, GATE_NEXT represents a next gate line adjacent to the gate line GATE, and a corresponding time sequence is a time sequence of a gate driving signal outputted from GATE_NEXT.

Figure 6:
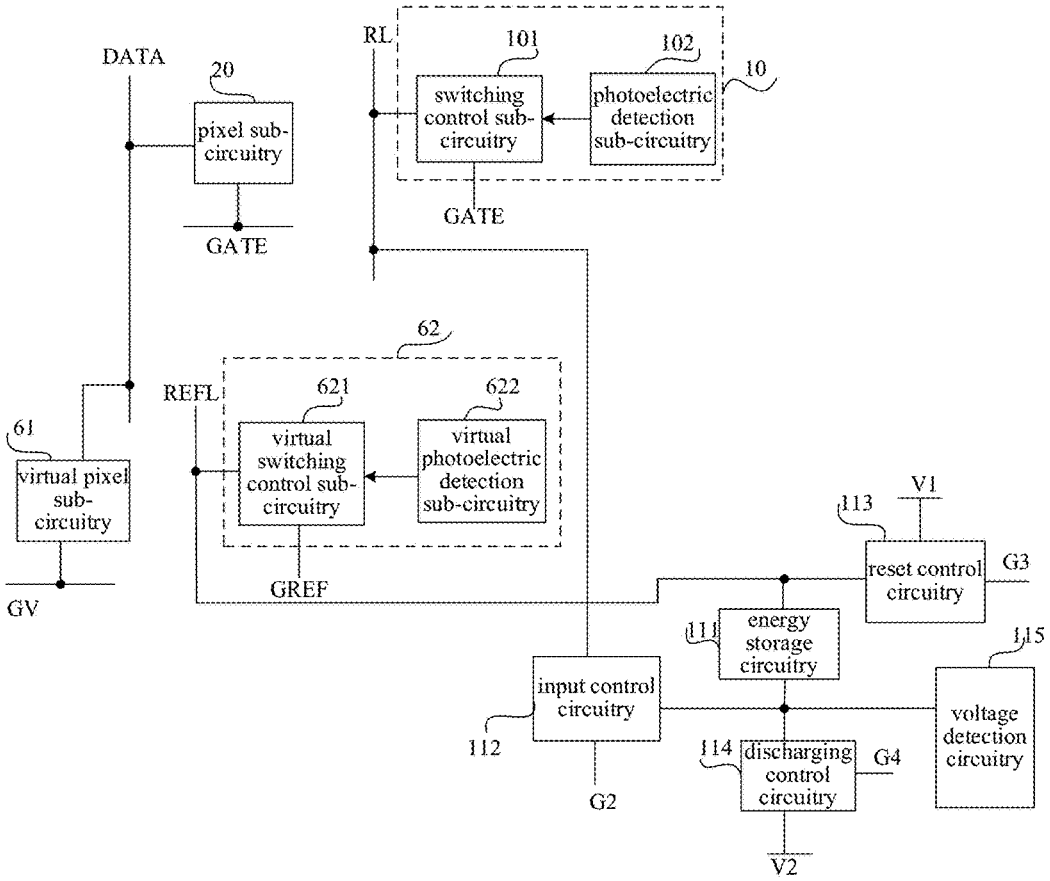
FIG. 6 is a schematic view showing an optical signal noise reduction circuit according to still yet another embodiment of the present disclosure.

As shown in FIG. 6, the pixel circuit may include the pixel sub-circuitry 20 and the optical detection sub-circuitry 10. The scanning control end of the pixel sub-circuitry 20 may be connected to the gate line GATE, and the data write-in end of the pixel sub-circuitry may be connected to the data line DATA. The optical detection sub-circuitry 10 may include the switching control sub-circuitry 101 and the photoelectric detection sub-circuitry 102. The control end of the switching control sub-circuitry 101 may be connected to the gate line GATE, the first end of the switching control sub-circuitry 101 may be connected to the output end of the photoelectric detection sub-circuitry 102, and the second end of the switching control sub-circuitry 101 may be connected to the photoelectric signal read line RL. The photoelectric signal read line RL may be arranged at a display region of the display panel.

The optical signal noise reduction circuit in the embodiments of the present disclosure may be applied to the pixel circuit, and it may include the reference line REFL, the photoelectric signal read line RL, the comparison detection circuitry 11, the noise simulation circuitry, the light-shielding member (not shown in FIG. 6), the virtual scanning line GV and the reference control line GREF. The reference line REFL may be arranged at the peripheral region of the display panel surrounding the display region of the display panel. The noise simulation circuitry, the light-shielding member, the virtual scanning line GV and the reference control line GREF may be arranged at the peripheral region of the display panel.

The comparison detection circuitry 11 may include the energy storage circuitry 111, the input control circuitry 112, the reset control circuitry 113, the discharging control circuitry 114 and the voltage detection circuitry 115.

The reference line REFL may be connected to the first end of the energy storage circuitry 111. The input control circuitry 112 may be connected to the first control line G2, the photoelectric signal read line RL and the second end of the energy storage circuitry 111, and configured to, under the control of the first control line G2, control the photoelectric signal read line RL to be electrically connected to, or electrically disconnected from, the second end of the energy storage circuitry 111. The reset control circuitry 113 may be connected to the second control line G3, the first end of the energy storage circuitry 111 and the first voltage end, and configured to, under the control of the second control line G3, control the first end of the energy storage circuitry 111 to be electrically connected to, or electrically disconnected from, the first voltage end. The first voltage end is configured to apply the first voltage V1. The discharging control circuitry 114 may be connected to the third control line G4, the second end of the energy storage circuitry 111 and the second voltage end, and configured to, under the control of the third control line G4, control the second end of the energy storage circuitry 111 to be electrically connected to, or electrically disconnected from, the second voltage end. The second voltage end is configured to apply the second voltage V2. The voltage detection circuitry 115 may be connected to the second end of the energy storage circuitry 111, and configured to detect a voltage applied to the second end of the energy storage circuitry 111 and acquire the photoelectric signal in accordance with the voltage applied to the second end of the energy storage circuitry 111.

The noise simulation circuitry may include a virtual pixel sub-circuitry 61 and a virtual optical detection sub-circuitry 62. A data write-in end of the virtual pixel sub-circuitry 61 may be connected to the data line DATA, and a scanning control end of the virtual pixel sub-circuitry 61 may be connected to the virtual scanning line GV. The virtual optical detection sub-circuitry 62 may include a virtual switching control sub-circuitry 621 and a virtual photoelectric detection sub-circuitry 622. The light-shielding member (not shown in FIG. 6) is configured to prevent the virtual photoelectric detection sub-circuitry 622 from receiving the optical signal. A control end of the virtual switching control sub-circuitry 621 may be connected to the reference control line GREF, a first end of the virtual switching control sub-circuitry 621 may be connected to an output end of the virtual photoelectric detection sub-circuitry 622, and a second end of the virtual switching control sub-circuitry 621 may be connected to the reference line REFL.

In actual use, the virtual scanning signal on GV may be the same as the gate driving signal on GATE.

During the implementation, the pixel circuits in one column may correspond to one noise simulation circuitry arranged at the peripheral region, and the virtual scanning signal on GV may be the same as the gate driving signal on the gate line which is currently being scanned. Through the noise simulation circuitry, the interference caused by GV and DATA on REFL may be similar to the interference caused by GATE and DATA on the photoelectric signal read line RL of the pixel circuit, so the electric signal on REFL may be approximately the same as the noise electric signal on RL.

In actual use, the noise simulation circuitry may be of a same structure as the pixel circuitry. To be specific, the virtual pixel sub-circuitry 61 of the noise simulation circuitry may be of a same structure as the pixel sub-circuitry 20 of the pixel circuit, and the virtual optical detection sub-circuitry 62 of the noise simulation circuitry may be of a same structure as the optical detection sub-circuitry 10 of the pixel circuit, so as to enable the interference caused by GV and DATA on REFL to be the same as the interference caused by GATE and DATA on the photoelectric signal read line RL of the pixel circuit. In addition, in the embodiments of the present disclosure, through the light-shielding member (not shown in FIG. 6), the virtual photoelectric detection sub-circuitry 622 of the noise simulation circuitry is incapable of receiving the optical signal, so the electric signal on the reference line REFL may be merely the noise electric signal. The electric signal on the photoelectric signal read line RL may include the photoelectric signal and the noise electric signal, so the photoelectric signal may be acquired in accordance with the electric signal on REFL and the electric signal on RL.

During the implementation, the first voltage V1 and the second voltage V2 may each be, but not limited to, a low voltage.

To be specific, the gate driving signal on the gate line may be adopted to provide the virtual scanning signal for the virtual scanning line.

During the implementation, the comparison detection circuitry may include an energy storage circuitry, an input control circuitry, a reset control circuitry, a discharging control circuitry and a voltage detection circuitry. The reference line may be connected to the first end of the energy storage circuitry. The input control circuitry may be connected to the first control line, the photoelectric signal read line and the second end of the energy storage circuitry, and configured to, under the control of the first control line, control the photoelectric signal read line to be electrically connected to, or electrically disconnected from, the second end of the energy storage circuitry. The reset control circuitry may be connected to the second control line, the first end of the energy storage circuitry and the first voltage end, and configured to, under the control of the second control line, control the first end of the energy storage circuitry to be electrically connected to, or electrically disconnected from, the first voltage end. The discharging control circuitry may be connected to the third control line, the second end of the energy storage circuitry and the second voltage end, and configured to, under the control of the third control line, control the second end of the energy storage circuitry to be electrically connected to, or electrically disconnected from, the second voltage end. The voltage detection circuitry may be connected to the second end of the energy storage circuitry, and configured to, detect a voltage applied to the second end of the energy storage circuitry, and acquire the photoelectric signal in accordance with the voltage applied to the second end of the energy storage circuitry.

To be specific, the energy storage circuitry may include a storage capacitor. A first end of the storage capacitor may be connected to the reference line. The input control circuitry may include a third transistor, a gate electrode of which is connected to the first control line, a first electrode of which is connected to the photoelectric signal read line, and a second electrode of which is connected to the second end of the storage capacitor.

To be specific, the reset control circuitry may include a reset control transistor, a gate electrode of which is connected to the second control line, a first electrode of which is connected to the first end of the storage capacitor, and a second electrode of which is connected to the first voltage end. The discharging control circuitry may include a discharging control transistor, a gate electrode of which is connected to the third control line, a first electrode of which is connected to the second end of the storage capacitor, and a second electrode of which is connected to the second voltage end.

To be specific, the voltage detection circuitry may include a source follower transistor, a current source and a voltage detection sub-circuitry. A gate electrode of the source follower transistor may be connected to the second end of the storage capacitor, a first electrode of the source follower transistor may be connected to a third voltage end, and a second electrode of the source follower transistor may be connected to an output node. A first end of the current source may be connected to the output node, and a second end of the current source may be connected to a fourth voltage end. The current source is configured to supply a bias current flowing from the output node to the fourth voltage end. The voltage detection sub-circuitry may be connected to the output node, and configured to detect a potential at the output node and acquire the photoelectric signal in accordance with the potential at the output node.

To be specific, the virtual pixel sub-circuitry may include a virtual data write-in sub-circuitry, a virtual driving sub-circuitry and a virtual light-emitting element. A control end of the virtual data write-in sub-circuitry may be the scanning control end of the virtual pixel sub-circuitry, a first end of the virtual data write-in sub-circuitry may be the data write-in end of the virtual pixel sub-circuitry, and a second end of the virtual data write-in sub-circuitry may be a control end of the virtual driving sub-circuitry. The virtual data write-in sub-circuitry is configured to, under the control of the virtual scanning line, control the data line to be electrically connected to, or electrically disconnected from, the control end of the virtual driving sub-circuitry. A first end of the virtual driving sub-circuitry may be connected to a high voltage end, a second end of the virtual driving sub-circuitry may be connected to a first electrode of the virtual light-emitting element, and a second electrode of the virtual light-emitting element may be connected to a low voltage end.

To be specific, the virtual data write-in sub-circuitry may include a virtual data write-in transistor, and the virtual driving sub-circuitry may include a virtual driving transistor. A gate electrode of the virtual data write-in transistor may be the control end of the virtual data write-in sub-circuitry, the first electrode of the virtual data write-in transistor may be the first end of the virtual data write-in sub-circuitry, and a second electrode of the virtual data write-in transistor may be the second end of the virtual data write-in sub-circuitry. A gate electrode of the virtual driving transistor may be the control end of the virtual driving sub-circuitry, a first electrode of the virtual driving transistor may be the first end of the virtual driving sub-circuitry, and a second electrode of the virtual driving transistor may be the second end of the virtual driving sub-circuitry.

The virtual photoelectric detection sub-circuitry may include a virtual photodiode, an anode of which is connected to the low voltage end. The virtual switching control sub-circuitry may include a virtual switching control transistor, a gate electrode of which is connected to the reference control line, a first electrode of which is connected to a cathode of the virtual photodiode, and a second electrode of which is connected to the reference line. The light-shielding member is further configured to shield the virtual photodiode, so as to prevent the virtual photodiode from receiving the optical signal.

During the operation of the optical signal noise reduction circuit in FIG. 6, the corresponding line scanning stage may include an input time period, a detection time period and a resetting time period arranged sequentially in that order.

Within the input time period of the corresponding line scanning stage, the pixel sub-circuitry 20 may start to emit light, and the photoelectric detection sub-circuitry 102 may convert an optical signal from the pixel sub-circuitry 20 into a corresponding photoelectric signal. The switching control sub-circuitry 101 may control the output end of the photoelectric detection sub-circuitry 102 to be electrically connected to the photoelectric signal read line RL. Under the control of the reference control line GREF, the virtual switching control sub-circuitry 621 may control the output end of the virtual photoelectric detection sub-circuitry 622 to be electrically connected to the reference line (at this time, the virtual photoelectric detection sub-circuitry 622 is shielded by the light-shielding member, so the virtual photoelectric detection sub-circuitry 622 may not receive the optical signal, and the virtual photoelectric detection sub-circuitry 622 is only subjected to the interference caused by GV and DATA but cannot perform photovoltaic conversion). Under the control of the first control line G2, the input control circuitry 112 may control the photoelectric signal read line RL to be electrically connected to the second end of the energy storage circuitry 111, so as to charge the energy storage circuitry 111 through the electric signal on the reference line REFL and the electric signal on the photoelectric signal read line RL, thereby to enable a difference between the voltages applied to the first end and the second end of the energy storage circuitry 111 to be the photoelectric signal. Under the control of the second control line G3, the resetting control circuitry 113 may control the first end of the energy storage circuitry 111 to be electrically disconnected from the first voltage end. Under the control of the third control line G4, the discharging control circuitry 114 may control the second end of the energy storage circuitry 111 to be electrically disconnected from the second voltage end.

Within the detection time period of the corresponding line scanning stage, a value of the first voltage applied by the first voltage end may be 0. Under the control of the reference control line GREF, the virtual switching control sub-circuitry 621 may control the output end of the virtual photoelectric detection sub-circuitry 622 to be electrically disconnected from the reference line REFL. Under the control of the first control line G2, the input control circuitry 112 may control the photoelectric signal read line RL to be electrically disconnected from the second end of the energy storage circuitry 111. Under the control of the third control line G4, the discharging control circuitry 114 may control the second end of the energy storage circuitry 111 to be electrically disconnected tom the second voltage end. Under the control of the second control line G3, the reset control circuitry 113 may control the first end of the energy storage circuitry 111 to be electrically connected to the first voltage end, so as to enable the voltage applied to the second end of the energy storage circuitry 111 to be the photoelectric signal. The detection voltage circuitry 115 may detect the photoelectric signal.

Within the resetting time period of the corresponding line scanning stage, under the control of the second control line G3, the reset control circuitry 113 may control the first end of the energy storage circuitry 111 to be electrically disconnected from the first voltage end. Under the control of the reference control line GREF, the virtual switching control sub-circuitry 621 may control the output end of the virtual photoelectric detection sub-circuitry 622 to be electrically connected to the reference line REFL, so as to reset a potential at the output end of the virtual photoelectric detection sub-circuitry 622. Under the control of the first control line G2, the input control circuitry 112 may be control the photoelectric signal read line RL to be electrically connected to the second end of the energy storage circuitry 111. Under the control of the third control line G4, the discharging control circuitry 114 may control the second end of the energy storage circuitry 111 to be electrically connected to the second voltage end, so as to discharge the energy storage circuitry, and reset a potential at the output end of the photoelectric detection sub-circuitry 102 through the photoelectric signal read line RL.

A relationship between the noise simulation circuitry and the pixel circuit will be described hereinafter in conjunction with the drawings.

Figure 7:
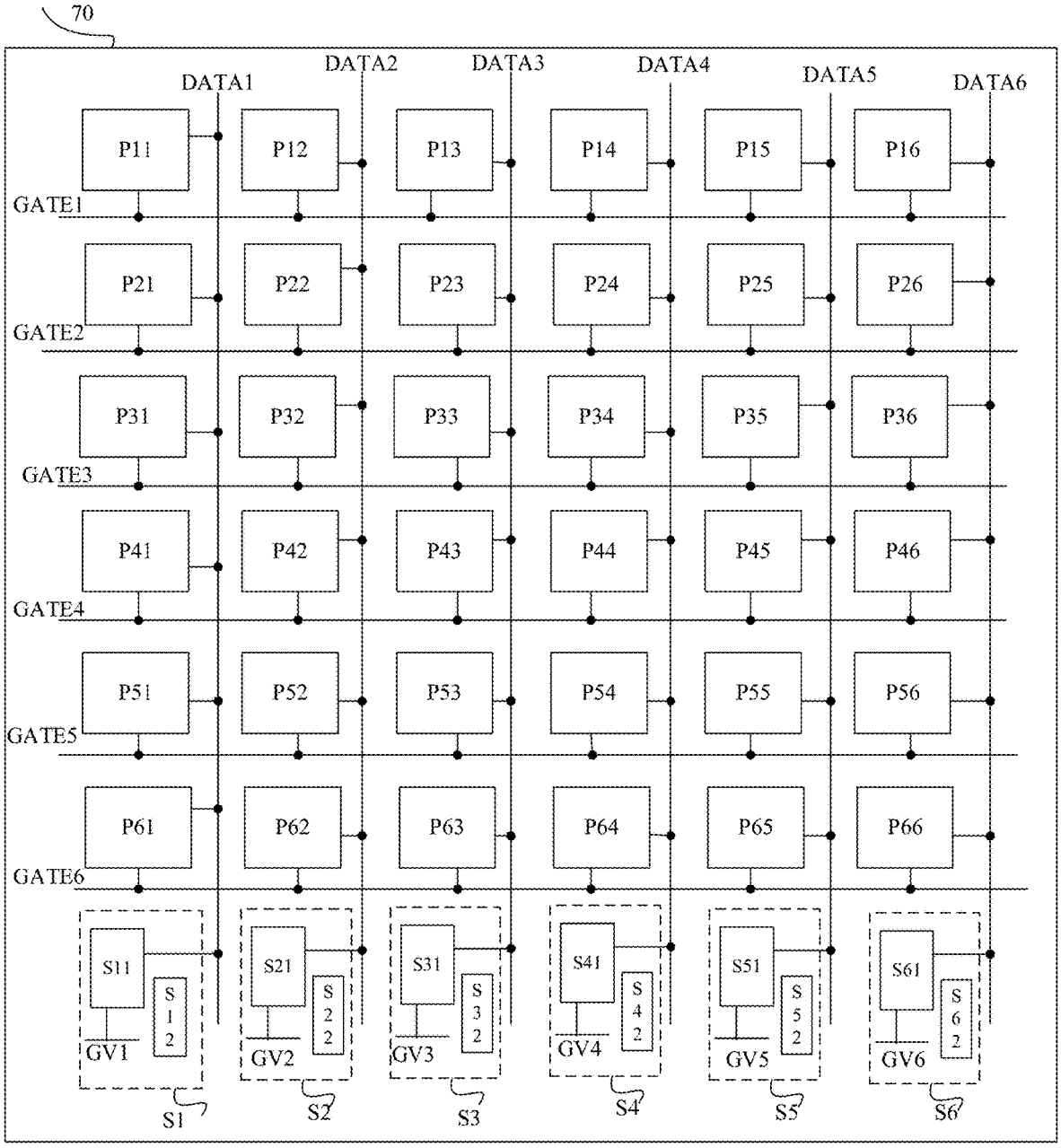
FIG. 7 is a schematic view showing a relationship between a noise simulation circuitry and a pixel circuit according to an embodiment of the present disclosure.

As shown in FIG. 7, the pixel circuits may be arranged in six rows and six columns at the display region of the display panel, and each pixel circuit may include the pixel sub-circuitry and the optical detection sub-circuitry. The pixel circuits in a first row are connected to a first gate line GATE1 in the first row, the pixel circuits in a second row are connected to a second gate line GATE2 in the second row, the pixel circuits in a third row are connected to a third gate line GATE1 in the third row, the pixel circuits in a fourth row are connected to a fourth gate line GATE4 in the fourth row, the pixel circuits in a fifth row are connected to a fifth gate line GATE5 in the fifth row, and the pixel circuits in a sixth row are connected to a sixth gate line GATE6 in the sixth row. The pixel circuits in a first column are connected to a first data line DATA1 in the first column, the pixel circuits in a second column are connected to a second data line DATA2 in the second column, the pixel circuits in a third column are connected to a third data line DATA3 in the third column, the pixel circuits in a fourth column are connected to a fourth data line DATA4 in the fourth column, the pixel circuits in a fifth column are connected to a fifth data line DATA5 in the fifth column, and the pixel circuits in a sixth column are connected to a sixth data line DATA6 in the sixth column.

In FIG. 7, P11 represents the pixel circuit in the first row and the first column, P12 represents the pixel circuit in the first row and the second column, P13 represents the pixel circuit in the first row and the third column, P14 represents the pixel circuit in the first row and the fourth column, P15 represents the pixel circuit in the first row and the fifth column, and P16 represents the pixel circuit in the first row and the sixth column. P21 represents the pixel circuit in the second row and the first column, P22 represents the pixel circuit in the second row and the second column, P23 represents the pixel circuit in the second row and the third column, P24 represents the pixel circuit in the second row and the fourth column, P25 represents the pixel circuit in the second row and the fifth column, and P26 represents the pixel circuit in the second row and the sixth column. P31 represents the pixel circuit in the third row and the first column, P32 represents the pixel circuit in the third row and the second column, P33 represents the pixel circuit in the third row and the third column, P34 represents the pixel circuit in the third row and the fourth column, P35 represents the pixel circuit in the third row and the fifth column, and P36 represents the pixel circuit in the third row and the sixth column. P41 represents the pixel circuit in the fourth row and the first column, P42 represents the pixel circuit in the fourth row and the second column, P43 represents the pixel circuit in the fourth row and the third column, P44 represents the pixel circuit in the fourth row and the fourth column, P45 represents the pixel circuit in the fourth row and the fifth column, and P46 represents the pixel circuit in the fourth row and the sixth column. P51 represents the pixel circuit in the fifth row and the first column, P52 represents the pixel circuit in the fifth row and the second column, P53 represents the pixel circuit in the fifth row and the third column, P54 represents the pixel circuit in the fifth row and the fourth column, P55 represents the pixel circuit in the fifth row and the fifth column, and P56 represents the pixel circuit in the fifth row and the sixth column. P61 represents the pixel circuit in the sixth row and the first column, P62 represents the pixel circuit in the sixth row and the second column, P63 represents the pixel circuit in the sixth row and the third column, P64 represents the pixel circuit in the sixth row and the fourth column, P65 represents the pixel circuit in the sixth row and the fifth column, and P66 represents the pixel circuit in the sixth row and the sixth column.

Six noise simulation circuitries, i.e., a first noise simulation circuitry S1, a second noise simulation circuitry S2, a third noise simulation circuitry S3, a fourth noise simulation circuitry S4, a fifth noise simulation circuitry S5 and a sixth noise simulation circuitry S6, may be arranged at the peripheral region of the display panel.

The first noise simulation circuitry S1 may correspond to the pixel circuits in the first column, the second noise simulation circuitry S2 may correspond to the pixel circuits in the second column, the third noise simulation circuitry S3 may correspond to the pixel circuits in the third column, the fourth noise simulation circuitry S4 may correspond to the pixel circuits in the fourth column, the fifth noise simulation circuitry S5 may correspond to the pixel circuits in the fifth column, and the sixth noise simulation circuitry S6 may correspond to the pixel circuits in the sixth column.

The first noise simulation circuitry S1 may include a first virtual pixel sub-circuitry S11 and a first virtual optical detection sub-circuitry S12. A data write-in end of the first virtual pixel sub-circuitry S11 may be connected to DATA1, and a scanning control end of the first virtual pixel sub-circuitry S11 may be connected to a first virtual scanning line GV1.

The second noise simulation circuitry S2 may include a second virtual pixel sub-circuitry S21 and a second virtual optical detection sub-circuitry S22. A data write-in end of the second virtual pixel sub-circuitry S21 may be connected to DATA2, and a scanning control end of the second virtual pixel sub-circuitry S21 may be connected to a second virtual scanning line GV2.

The third noise simulation circuitry S3 may include a third virtual pixel sub-circuitry S31 and a third virtual optical detection sub-circuitry S32. A data write-in end of the third virtual pixel sub-circuitry S31 may be connected to DATA3, and a scanning control end of the third virtual pixel sub-circuitry S31 may be connected to a third virtual scanning line GV3.

The fourth noise simulation circuitry S4 may include a fourth virtual pixel sub-circuitry S41 and a fourth virtual optical detection sub-circuitry S42. A data write-in end of the fourth virtual pixel sub-circuitry S41 may be connected to DATA4, and a scanning control end of the fourth virtual pixel sub-circuitry S41 may be connected to a fourth virtual scanning line GV4.

The fifth noise simulation circuitry S5 may include a fifth virtual pixel sub-circuitry S51 and a fifth virtual optical detection sub-circuitry S52. A data write-in end of the fifth virtual pixel sub-circuitry S51 may be connected to DATA5, and a scanning control end of the fifth virtual pixel sub-circuitry S51 may be connected to a fifth virtual scanning line GV5.

The sixth noise simulation circuitry S6 may include a sixth virtual pixel sub-circuitry S61 and a sixth virtual optical detection sub-circuitry S62. A data write-in end of the sixth virtual pixel sub-circuitry S61 may be connected to DATA6, and a scanning control end of the sixth virtual pixel sub-circuitry S61 may be connected to a sixth virtual scanning line GV5.

The optical signal noise reduction circuit of an embodiment of the present disclosure will be described hereinafter in more details.

Figure 8:
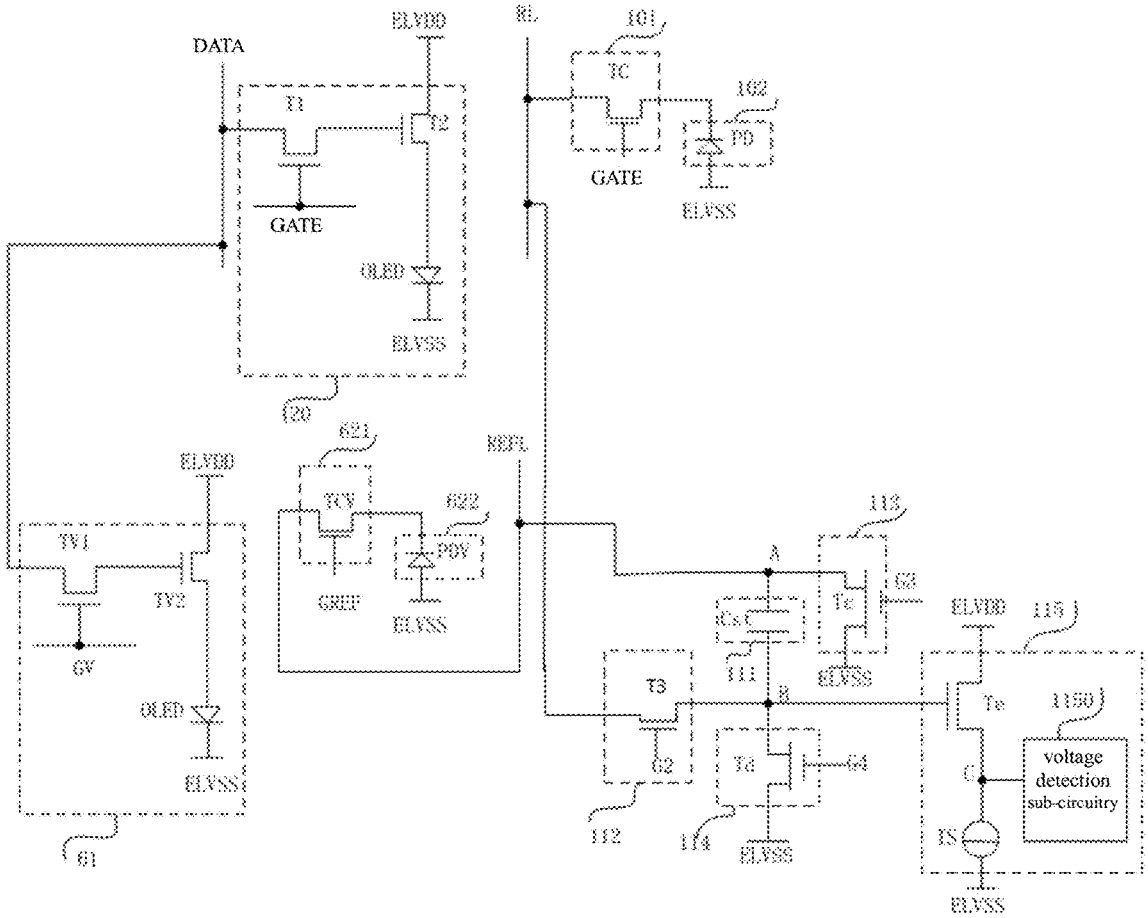
FIG. 8 is a circuit diagram of an optical signal noise reduction circuit according to another embodiment of the present disclosure.

As shown in FIG. 8, the optical signal noise reduction circuit may include the reference line REFL, the photoelectric signal read line RL, the comparison detection circuitry 11, the noise simulation circuitry, the light-shielding member (not shown in FIG. 8), the virtual scanning line GV and the reference control line GREF. The reference line REFL may be arranged at the peripheral region of the display panel. The noise simulation circuitry, the light-shielding member (not shown in FIG. 8), the virtual scanning line GV and the reference control line GREF may be arranged at the peripheral region of the display panel.

The comparison detection circuitry 11 may include the energy storage circuitry 111, the input control circuitry 112, the reset control circuitry 113, the discharging control circuitry 114 and the voltage detection circuitry 115. The energy storage circuitry 111 may include a storage capacitor Cst, a first end of which is connected to the reference line REFL.

The input control circuitry 112 may include a third transistor T3, a gate electrode of which is connected to the first control line G2, a drain electrode of which is connected to the photoelectric signal read line RL, and a source electrode of which is connected to a second end B of the storage capacitor Cst.

The reset control circuitry 113 may include a reset control transistor Tc, a gate electrode of which is connected to the second control line G3, a drain electrode of which is connected to the first end A of the storage capacitor Cst, and a source electrode of which is connected to the low voltage end ELVSS.

The discharging control circuitry 114 may include a discharging control transistor Td, a gate electrode of which is connected to the third control line G4, a drain electrode of which is connected to the second end B of the storage capacitor Cst, and a source electrode of which is connected to the low voltage end ELVSS.

The voltage detection circuitry 115 may include a source follower transistor Te, a current source IS, and a voltage detection sub-circuitry 1150. A gate electrode of the source follower transistor Te may be connected to the second end B of the storage capacitor Cst, a drain electrode of the source follower transistor Te may be connected to the high voltage end ELVDD, and a source electrode of the source follower transistor Te may be connected to the output node C. A first end of the current source IS may be connected to the output node C, and a second end of the current source IS may be connected to the low voltage end ELVSS. The current source IS is configured to provide a bias current flowing from the output node C to the low voltage end ELVSS. The voltage detection sub-circuitry 1150 may be connected to the output node C, and configured to detect a potential at the output node C and acquire the photoelectric signal in accordance with the potential at the output node C.

The noise simulation circuitry may include a virtual pixel sub-circuitry 61 and a virtual optical detection sub-circuitry. The virtual optical detection sub-circuitry may include a virtual switching control sub-circuitry 621 and a virtual photoelectric detection sub-circuitry 622. The virtual pixel sub-circuitry 61 may include a virtual data write-in sub-circuitry 611, a virtual driving sub-circuitry, and a virtual light-emitting element (i.e., a virtual organic light-emitting diode OLEDV).

The virtual data write-in sub-circuitry 611 may include a virtual data write-in transistor TV1, and the virtual driving sub-circuitry may include a virtual driving transistor TV2. A gate electrode of the virtual data write-in transistor TV1 may be connected to the virtual scanning line GV, a drain electrode of the virtual data write-in transistor TV1 may be connected to the data line DATA, and a source electrode of the virtual data write-in transistor TV1 may be connected to a gate electrode of TV2. A drain electrode of the virtual driving transistor TV2 may be connected to the high voltage end EVLDD, a source electrode of the virtual driving transistor TV2 may be connected to an anode of the virtual organic light-emitting diode OLEDV, and a cathode of the virtual organic light-emitting diode OLEVD may be connected to the low voltage end ELVSS.

The virtual photoelectric detection sub-circuitry 622 may include a virtual photodiode PDV, an anode of which is connected to the low voltage end ELVSS. The virtual switching control sub-circuitry 621 may include a virtual switching control transistor TCV, a gate electrode of which is connected to the control reference line GREF, a drain electrode of which is connected to a cathode of the virtual photodiode PDV, and a source electrode of which is connected to the reference line REFL. The light-shielding member (not shown in FIG. 8) is further configured to shield the virtual photodiode PDV, to prevent the virtual photodiode PDV from receiving the optical signal.

In the embodiment of FIG. 8, all the transistors may be n-type transistors. However, in actual use, the transistors may alternately be p-type transistors, i.e., the types of the transistors will not be particularly defined herein.

In the embodiment of FIG. 8, a waveform of a reference control signal on GREF may be the same as a waveform of a first control signal on G2. The virtual scanning signal on GV may be the same as the gate driving signal on the gate line which is currently being scanned. For example, when the first gate line in the first row is being scanned (i.e., a first gate driving signal is applied to the first gate line in the first row to turn on the first gate line in the first row), the virtual scanning signal on GV may be the same as the first gate driving signal on the first gate line in the first row (the virtual scanning signal may also have a rising edge from a low level to a high level and a falling edge from a high level to a low level); when the second gate line in the second row is being scanned (i.e., a second gate driving scanning signal is applied to the second gate line in the second row to turn on the second gate line in the second row), the virtual scanning signal on GV may be the same as the second gate driving signal on the second gate line in the second row (the virtual scanning signal may also have a rising edge from a low level to a high level and a falling edge from a high level to a low level), and so on.

In the embodiment of FIG. 8, when Te is in the saturation state, $\Delta Vs=(gm\times Ro)\times\Delta Vg/(1+gm\times Ro)$, where Ro represents an equivalent resistance value of the current source IS, gm represents a transconductance of the source follower transistor Te, $\Delta Vs$ represents a change in a voltage applied to the source electrode of Te, and $\Delta Vg$ represents a change in a voltage applied to the gate electrode of Te. When $gm\times Ro$ is sufficiently large, $\Delta Vs$ may be approximately equal to $\Delta Vg$. Based on the above equation, a following coefficient sg of the source follower transistors Te may be equal to $(gm\times Ro)\times/(1+gm\times Ro)$.

In the embodiment of FIG. 8, gm and Ro may each be provided with a sufficiently large value, so as to enable sg to be approximately equal to 1, and enable $\Delta Vs$ to be approximately equal to $\Delta Vg$. The bias current is supplied for the operation of the source follower transistor Te.

Figure 9:
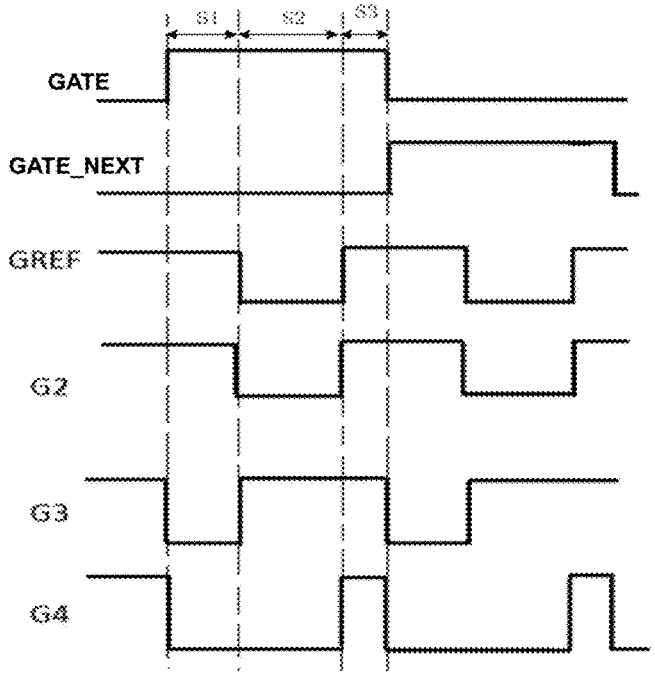
FIG. 9 is an operation sequence diagram of the optical signal noise reduction circuit in FIG. 8 according to an embodiment of the present disclosure.

As shown in FIG. 9, during the operation of the optical signal noise reduction circuit in FIG. 8, the corresponding line scanning stage may include an input time period S1, a detection time period S2 and a resetting time period S3 arranged sequentially in that order.

Within the input time period S1 of the corresponding line scanning stage, GATE may output a high level, GV may output a high level, and OLED may start to emit light. PD may sense an optical signal from OLED, and convert the optical signal into a photoelectric signal. G2 may output a high level, GREF may output a high level, G3 may output a low level, and G4 may output a low level, so as to turn on TCV and T3, and turn off Tc and Td. Cst may be charged through the noise current signal on REFL and the photo current signal including the noise current signal on RL. At this time, a voltage applied to the first end A of Cst may be a noise voltage, and a voltage applied to the second end B of Cst may include a noise voltage and a photo voltage. Hence, a difference between the voltage applied to the second end B of Cst and the voltage applied to the first end A of Cst may be just the photo voltage. Within the input time period S1, Te may operate in the saturation state.

Within the detection time period S2 of the corresponding line scanning stage, GATE may output a high level, and a value of a low voltage applied by ELVSS may be 0. G2 and GREF may each output a low voltage, G3 may output a high voltage, and G4 may output a low voltage, so as to turn off TCV, T3 and Td, and turn on Tc, so the voltage applied to the first end A of Cst may be 0. A difference between the voltages applied to two ends of Cst cannot change suddenly, so the voltage applied to the second end B of Cst may be just the photo voltage. At this time, Te may operate in the saturation stage. The voltage detection circuitry 115 may detect a voltage Vs applied to the source electrode of Te, and subtract an initial source voltage (i.e., a voltage applied to the source electrode of Te detected by the voltage detection circuitry 115 before S1 (i.e., at a moment immediately before S1)) from Vs, so as to acquire a voltage difference as the photo voltage.

Within the resetting time period S3 of the corresponding line scanning stage, GATE may output a high level, and GREF, G2, G3 and G4 may each output a high level, so as to turn on TCV, T3, Tc, Td and TC, thereby to reset the voltages applied to the first end A and the second end B of Cst, a voltage across REFL, a voltage across RL, a voltage applied to the cathode of PD, and a voltage applied to the cathode of PDV.

The present disclosure further provides in some embodiments an optical signal noise reduction method for the above-mentioned optical signal noise reduction circuit, which includes, at the corresponding line scanning stage, turning on the corresponding gate line connected the pixel circuit, and enabling the comparison detection circuitry to acquire the photoelectric signal in accordance with the electric signal on the photoelectric signal read line in the corresponding column and the electric signal on the reference line.

To be specific, the reference line and the photoelectric signal read line may be arranged at the display region of the display panel, the reference line may extend in a same direction as the photoelectric signal read line, and a distance between the reference line and the photoelectric signal read line may be smaller than a predetermined distance. The comparison detection circuitry may include an energy storage circuitry, an input control circuitry, a reset control circuitry, a discharging control circuitry and a voltage detection circuitry. The corresponding line scanning stage may include an input time period and a detection time period arranged one after another. The optical signal noise reduction method may include: within the input time period of the corresponding line scanning stage, controlling, by the input control circuitry, the reference line to be electrically connected to a first end of the energy storage circuitry and controlling, by the input control circuitry, the photoelectric signal read line to be electrically connected to a second end of the energy storage circuitry under the control of a first control line, so as to charge the energy storage circuitry through the second electric signal on the reference line and the first electric signal on the photoelectric signal read line, thereby to enable a difference between a voltage applied to the second end of the energy storage circuitry and a voltage applied to the first end of the energy storage circuitry to be a photoelectric signal; and controlling, by the reset control circuitry, the first end of the energy storage circuitry to be electrically disconnected from a first voltage end under the control of a second control line; and within the detection time period of the corresponding line scanning stage, detecting, by the voltage detection circuitry, the photoelectric signal, controlling, by the input control circuitry, the reference line to be electrically disconnected from the first end of the energy storage circuitry and controlling, by the input control circuitry, the photoelectric signal read line to be electrically disconnected from the second end of the energy storage circuitry under the control of the first control line; controlling, by the reset control circuitry, the first end of the energy storage circuitry to be electrically connected to the first voltage end under the control of the second control line, and controlling, by the discharging control circuitry, the second end of the energy storage circuitry to be electrically disconnected from a second voltage end under the control of a third control line.

The present disclosure further provides in some embodiments a display panel, including pixel circuits arranged in N columns and N optical signal noise reduction circuits each corresponding to the pixel circuits in a respective one column, where N is a positive integer greater than 1, and n is a positive integer smaller than or equal to N. The pixel circuits may be arranged at a display region of the display panel. A comparison detection circuitry of the optical signal noise reduction circuit may be arranged a peripheral region of the display panel surrounding the display region of the display panel. A reference line and a photoelectric signal read line of the optical signal noise reduction circuit may be arranged at the display region, the reference line may extend in a same direction as the photoelectric signal read line, and a distance between the reference line and the photoelectric signal read line may be smaller than a predetermined distance; or the reference line may be arranged at the peripheral region of the display panel, the optical signal noise reduction circuit may further include a noise simulation circuitry, a light-shielding member, a virtual scanning line and a reference control line arranged at the peripheral region, and the noise simulation circuitry may be of a same structure as the pixel circuit.

The above embodiments are merely optional embodiments of the present disclosure. It should be appreciated that, a person skilled in the art may make further modifications and improvements without departing from the spirit of the present disclosure, and these modifications and improvements shall also fall within the scope of the present disclosure.

What is claimed is:

1. An optical signal noise reduction circuit, comprising:

a reference line;

a comparison detection circuitry; and a photoelectric signal read line, wherein a first electric signal on the photoelectric signal read line comprises a noise electric signal and a photoelectric signal, wherein the reference line is configured to sense the noise electric signal on the photoelectric signal read line, to generate a corresponding second electric signal on the reference line, wherein the comparison detection circuitry is connected to the reference line and the photoelectric signal read line, and configured to acquire the photoelectric signal in accordance with the first electric signal on the photoelectric signal read line and the second electric signal on the reference line, wherein the reference line and the photoelectric signal read line are arranged at a display region of a display panel, an extension direction of the reference line is same as an extension direction of the photoelectric signal read line, and a distance between the reference line and the photoelectric signal read line is smaller than a predetermined distance, wherein the comparison detection circuitry comprises an energy storage circuitry, an input control circuitry, a reset control circuitry, a discharging control circuitry and a voltage detection circuitry, wherein the input control circuitry is connected to a first control line, the reference line, the photoelectric signal read line, a first end of the energy storage circuitry and a second end of the energy storage circuitry, and configured to, under control of the first control line, control the reference line to be electrically connected to, or electrically disconnected from, the first end of the energy storage circuitry, and control the photoelectric signal read line to be electrically connected to, or electrically disconnected from, the second end of the energy storage circuitry, wherein the reset control circuitry is connected to a second control line, the first end of the energy storage circuitry and a first voltage end, and configured to, under control of the second control line, control the first end of the energy storage circuitry to be electrically connected to, or electrically disconnected from, the first voltage end, wherein the discharging control circuitry is connected to a third control line, the second end of the energy storage circuitry and a second voltage end, and configured to, under control of the third control line, control the second end of the energy storage circuitry to be electrically connected to, or electrically disconnected from, the second voltage end, and wherein the voltage detection circuitry is connected to the second end of the energy storage circuitry and configured to detect a voltage applied to the second end of the energy storage circuitry and acquire the photoelectric signal in accordance with the voltage applied to the second end of the energy storage circuitry.

2. The optical signal noise reduction circuit according to claim 1, wherein the predetermined distance is smaller than 5 μm.

3. The optical signal noise reduction circuit according to claim 1, wherein the energy storage circuitry comprises a storage capacitor;

the input control circuitry comprises a first transistor and a second transistor;

a gate electrode of the first transistor is connected to the first control line, a first electrode of the first transistor is connected to the reference line, and a second electrode of the first transistor is connected to a first end of the storage capacitor; and a gate electrode of the second transistor is connected to the first control line, a first electrode of the second transistor is connected to the photoelectric signal read line, and a second electrode of the second transistor is connected to a second end of the storage capacitor.

4. The optical signal noise reduction circuit according to claim 3, wherein the reset control circuitry comprises a reset control transistor, a gate electrode of the reset control transistor is connected to the second control line, a first electrode of the reset control transistor is connected to the first end of the storage capacitor, and a second electrode of the reset control transistor is connected to the first voltage end; and the discharging control circuitry comprises a discharging control transistor, a gate electrode of the discharging control transistor is connected to the third control line, a first electrode of the discharging control transistor is connected to the second end of the storage capacitor, and a second electrode of the discharging control transistor is connected to the second voltage end.

5. The optical signal noise reduction circuit according to claim 3, wherein the voltage detection circuitry comprises a source follower transistor, a current source and a voltage detection sub-circuitry;

a gate electrode of the source follower transistor is connected to the second end of the storage capacitor, a first electrode of the source follower transistor is connected to a third voltage end, and a second electrode of the source follower transistor is connected to an output node;

a first end of the current source is connected to the output node, a second end of the current source is connected to a fourth voltage end, and the current source is configured to supply a bias current flowing from the output node to the fourth voltage end; and the voltage detection sub-circuitry is connected to the output node, and configured to detect a potential at the output node and acquire the photoelectric signal in accordance with the potential at the output node.

6. An optical signal noise reduction method for the optical signal noise reduction circuit according to claim 1, wherein the optical signal noise reduction method comprises:

at a corresponding line scanning stage, turning on a gate line being in a corresponding row and connected to a pixel circuit, and enabling a comparison detection circuitry to acquire a photoelectric signal in accordance with a first electric signal on a photoelectric signal read line in a corresponding row and a second electric signal on a reference line.

7. The optical signal noise reduction method according to claim 6, wherein the reference line and the photoelectric signal read line are arranged at a display region of a display panel, an extension direction of the reference line is same as an extension direction of the photoelectric signal read line, and a distance between the reference line and the photoelectric signal read line is smaller than a predetermined distance;

the comparison detection circuitry comprises an energy storage circuitry, an input control circuitry, a reset control circuitry, a discharging control circuitry and a voltage detection circuitry;

the corresponding line scanning stage comprises an input time period and a detection time period arranged one after another in that order, wherein the optical signal noise reduction method comprises:

within the input time period of the corresponding line scanning stage, controlling, by the input control circuitry, the reference line to be electrically connected to a first end of the energy storage circuitry and controlling, by the input control circuitry, the photoelectric signal read line to be electrically connected to a second end of the energy storage circuitry under control of a first control line, to charge the energy storage circuitry through the second electric signal on the reference line and the first electric signal on the photoelectric signal read line, thereby to enable a difference between a voltage applied to the second end of the energy storage circuitry and a voltage applied to the first end of the energy storage circuitry to be a photoelectric signal; and controlling, by the reset control circuitry, the first end of the energy storage circuitry to be electrically disconnected from a first voltage end under control of a second control line; and within the detection time period of the corresponding line scanning stage, detecting, by the voltage detection circuitry, the photoelectric signal; controlling, by the input control circuitry, the reference line to be electrically disconnected from the first end of the energy storage circuitry and controlling, by the input control circuitry, the photoelectric signal read line to be electrically disconnected from the second end of the energy storage circuitry under the control of the first control line; controlling, by the reset control circuitry, the first end of the energy storage circuitry to be electrically connected to the first voltage end under the control of the second control line; and controlling, by the discharging control circuitry, the second end of the energy storage circuitry to be electrically disconnected from a second voltage end under control of a third control line.

8. A display panel, comprising pixel circuits arranged in N columns and N optical signal noise reduction circuits each according to claim 1, wherein each of the N optical signal noise reduction circuits corresponds to the pixel circuits in one column;

N is a positive integer greater than 1;

the pixel circuit is arranged at a display region of the display panel;

a comparison detection circuitry comprised in the optical signal noise reduction circuit is arranged a peripheral region of the display panel, and the peripheral region surrounds the display region;

wherein the reference line and the photoelectric signal read line comprised in the optical signal noise reduction circuit are arranged at the display region, an extension direction of the reference line is same as an extension direction of the photoelectric signal read line, and a distance between the reference line and the photoelectric signal read line is smaller than a predetermined distance; or the reference line is arranged at the peripheral region, the optical signal noise reduction circuit further comprises a noise simulation circuitry, a light-shielding member, a virtual scanning line and a reference control line arranged at the peripheral region, and a structure of the noise simulation circuitry is same as a structure of the pixel circuit.

9. An optical signal noise reduction circuit, comprising:

a reference line;

a comparison detection circuitry; and a photoelectric signal read line, wherein a first electric signal on the photoelectric signal read line comprises a noise electric signal and a photoelectric signal, wherein the reference line is configured to sense the noise electric signal on the photoelectric signal read line, to generate a corresponding second electric signal on the reference line, wherein the comparison detection circuitry is connected to the reference line and the photoelectric signal read line, and configured to acquire the photoelectric signal in accordance with the first electric signal on the photoelectric signal read line and the second electric signal on the reference line, wherein the photoelectric signal read line is arranged at a display region of a display panel, the reference line is arranged in such a manner as to surround a peripheral region of the display region, and the optical signal noise reduction circuit further comprises a noise simulation circuitry, a light-shielding member, a virtual scanning line and a reference control line arranged at the peripheral region, wherein the noise simulation circuitry comprises a virtual pixel sub-circuitry and a virtual optical detection sub-circuitry, wherein a data write-in end of the virtual pixel sub-circuitry is connected to a data line in a corresponding column, and a scanning control end of the virtual pixel sub-circuitry is connected to the virtual scanning line, wherein the virtual optical detection sub-circuitry comprises a virtual switching control sub-circuitry and a virtual photoelectric detection sub-circuitry, wherein the light-shielding member is configured to prevent the virtual photoelectric detection sub-circuitry from receiving the optical signal, wherein a control end of the virtual switching control sub-circuitry is connected to the reference control line, a first end of the virtual switching control sub-circuitry is connected to an output end of the virtual photoelectric detection sub-circuitry, and a second end of the virtual switching control sub-circuitry is connected to the reference line, wherein the comparison detection circuitry comprises an energy storage circuitry, an input control circuitry, a reset control circuitry, a discharging control circuitry and a voltage detection circuitry, wherein the reference line is connected to a first end of the energy storage circuitry, wherein the input control circuitry is connected to a first control line, the photoelectric signal read line, and a second end of the energy storage circuitry, and configured to, under control of the first control line, control the photoelectric signal read line to be electrically connected to, or electrically disconnected from, the second end of the energy storage circuitry, wherein the reset control circuitry is connected to a second control line, the first end of the energy storage circuitry and a first voltage end, and configured to, under control of the second control line, control the first end of the energy storage circuitry to be electrically connected to, or electrically disconnected from, the first voltage end, wherein the discharging control circuitry is connected to a third control line, the second end of the energy storage circuitry and a second voltage end, and configured to, under control of the third control line, control the second end of the energy storage circuitry to be electrically connected to, or electrically disconnected from, the second voltage end, and wherein the voltage detection circuitry is connected to the second end of the energy storage circuitry and configured to detect a voltage applied to the second end of the energy storage circuitry, and acquire the photoelectric signal in accordance with the voltage applied to the second end of the energy storage circuitry.

10. The optical signal noise reduction circuit according to claim 9, wherein a gate driving signal on a gate line is used to apply a virtual scanning signal to the virtual scanning line.

11. The optical signal noise reduction circuit according to claim 9, wherein the energy storage circuitry comprises a storage capacitor;

a first end of the storage capacitor is connected to the reference line;

the input control circuitry comprises a third transistor;

a gate electrode of the third transistor is connected to the first control line, a first electrode of the third transistor is connected to the photoelectric signal read line, and a second electrode of the third transistor is connected to a second end of the storage capacitor.

12. The optical signal noise reduction circuit according to claim 9, wherein the virtual pixel sub-circuitry comprises a virtual data write-in sub-circuitry, a virtual driving sub-circuitry and a virtual light-emitting element;

a control end of the virtual data write-in sub-circuitry is the scanning control end of the virtual pixel sub-circuitry, a first end of the virtual data write-in sub-circuitry is the data write-in end of the virtual pixel sub-circuitry, and a second end of the virtual data write-in sub-circuitry is a control end of the virtual driving sub-circuitry;

the virtual data write-in sub-circuitry is configured to, under control of the virtual scanning line, control the data line in the corresponding column to be electrically connected to, or electrically disconnected from, the control end of the virtual driving sub-circuitry; and a first end of the virtual driving sub-circuitry is connected to a high voltage end, a second end of the virtual driving sub-circuitry is connected to a first electrode of the virtual light-emitting element, and a second electrode of the virtual light-emitting element is connected to a low voltage end.

13. An optical signal noise reduction circuit, comprising:

a reference line;

a comparison detection circuitry; and a photoelectric signal read line, wherein a first electric signal on the photoelectric signal read line comprises a noise electric signal and a photoelectric signal, wherein the reference line is configured to sense the noise electric signal on the photoelectric signal read line, to generate a corresponding second electric signal on the reference line, wherein the comparison detection circuitry is connected to the reference line and the photoelectric signal read line, and configured to acquire the photoelectric signal in accordance with the first electric signal on the photoelectric signal read line and the second electric signal on the reference line, wherein the photoelectric signal read line is arranged at a display region of a display panel, the reference line is arranged in such a manner as to surround a peripheral region of the display region, and the optical signal noise reduction circuit further comprises a noise simulation circuitry, a light-shielding member, a virtual scanning line and a reference control line arranged at the peripheral region, wherein the noise simulation circuitry comprises a virtual pixel sub-circuitry and a virtual optical detection sub-circuitry, wherein a data write-in end of the virtual pixel sub-circuitry is directly connected to a data line in a corresponding column, and a scanning control end of the virtual pixel sub-circuitry is directly connected to the virtual scanning line, wherein the virtual optical detection sub-circuitry comprises a virtual switching control sub-circuitry and a virtual photoelectric detection sub-circuitry, wherein the light-shielding member is configured to prevent the virtual photoelectric detection sub-circuitry from receiving the optical signal, and wherein a control end of the virtual switching control sub-circuitry is directly connected to the reference control line, a first end of the virtual switching control sub-circuitry is directly connected to an output end of the virtual photoelectric detection sub-circuitry, and a second end of the virtual switching control sub-circuitry is directly connected to the reference line.

14. The optical signal noise reduction circuit according to claim 13, wherein the comparison detection circuitry comprises an energy storage circuitry, an input control circuitry, a reset control circuitry, a discharging control circuitry ad a voltage detection circuitry;

the reference line is directly connected to a first end of the energy storage circuitry;

the input control circuitry is directly connected to a first control line, the photoelectric signal read line and a second end of the energy storage circuitry, and configured to, under control of the first control line, control the photoelectric signal read line to be electrically connected to, or electrically disconnected from, the second end of the energy storage circuitry;

the reset control circuitry is directly connected to a second control line, the first end of the energy storage circuitry and a first voltage end, and configured to, under control of the second control line, control the first end of the energy storage circuitry to be electrically connected to, or electrically disconnected from, the first voltage end;

the discharging control circuitry is directly connected to a third control line, the second end of the energy storage circuitry and a second voltage end, and configured to, under control of the third control line, control the second end of the energy storage circuitry to be electrically connected to, or electrically disconnected from, the second voltage end; and the voltage detection circuitry is directly connected to the second end of the energy storage circuitry, and configured to detect a voltage applied to the second end of the energy storage circuitry and acquire the photoelectric signal in accordance with the voltage applied to the second end of the energy storage circuitry.

15. The optical signal noise reduction circuit according to claim 14, wherein the energy storage circuitry comprises a storage capacitor;

a first end of the storage capacitor is directly connected to the reference line;

the input control circuitry comprises a third transistor;

a gate electrode of the third transistor is directly connected to the first control line, a first electrode of the third transistor is directly connected to the photoelectric signal read line, and a second electrode of the third transistor is directly connected to a second end of the storage capacitor.

* * * * *